US009469423B2

(12) United States Patent
Thomas, Jr. et al.

(10) Patent No.: US 9,469,423 B2
(45) Date of Patent: Oct. 18, 2016

(54) FLEXIBLE PACKAGE WITH REINFORCED TOP AND METHOD OF FILLING THE SAME

(71) Applicant: Fres-co System USA, Inc., Telford, PA (US)

(72) Inventors: John Sheridan Thomas, Jr., Coopersburg, PA (US); Menaka Hemamali Abeygunawardena, Ambler, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 14/202,118

(22) Filed: Mar. 10, 2014

(65) Prior Publication Data

US 2014/0270580 A1 Sep. 18, 2014

Related U.S. Application Data

(60) Provisional application No. 61/777,449, filed on Mar. 12, 2013.

(51) Int. Cl.

| | |
|---|---|
| ***B65B 3/17*** | (2006.01) |
| ***B65D 75/00*** | (2006.01) |
| ***B65D 75/56*** | (2006.01) |
| ***B65D 75/58*** | (2006.01) |
| ***B65D 33/25*** | (2006.01) |

(52) U.S. Cl.

CPC ..... *B65B 3/17* (2013.01); *B65D 33/2508* (2013.01); *B65D 75/008* (2013.01); *B65D 75/566* (2013.01); *B65D 75/5805* (2013.01); *B65D 75/5855* (2013.01); *B65D 75/5877* (2013.01); *B65D 75/5883* (2013.01); *B65D 2575/586* (2013.01)

(58) Field of Classification Search

CPC ..... B65D 33/08; B65D 33/10; B65D 33/12; B65D 33/14; B65D 75/005; B65D 75/566; B65D 75/5805; B65D 75/5855; B65D 75/5883; B65D 75/5877; B65D 33/2508; B65D 2575/586; B65B 3/17

USPC ..... 383/6, 7, 26

See application file for complete search history.

(56) References Cited

U.S. PATENT DOCUMENTS

| | | | | | |
|---|---|---|---|---|---|
| 3,240,420 | A | * | 3/1966 | Membrino | 383/10 |
| 3,653,583 | A | * | 4/1972 | Meyer | 383/26 |
| 3,986,661 | A | * | 10/1976 | Johnson | 383/7 |
| 4,252,269 | A | * | 2/1981 | Peppiatt | 383/25 |
| 4,518,087 | A | | 5/1985 | Goglio | |
| 4,576,316 | A | * | 3/1986 | Foster | 222/541.6 |
| 4,691,368 | A | * | 9/1987 | Roessiger | 383/10 |
| 4,705,174 | A | | 11/1987 | Goglio | |
| 4,738,546 | A | * | 4/1988 | Sengewald | 383/7 |
| 4,779,998 | A | * | 10/1988 | Wischusen, III | A45C 3/04 383/104 |
| 4,781,471 | A | * | 11/1988 | Sengewald | 383/7 |
| 4,878,764 | A | * | 11/1989 | Meyer | 383/72 |

(Continued)

*Primary Examiner* — Peter Helvey

(74) *Attorney, Agent, or Firm* — Caesar Rivise, PC

(57) ABSTRACT

Flexible packages and methods of filling them are disclosed. The package includes front and a rear panels. The front and rear panels each have a pair of side edges, a bottom edge, and a top edge. Respective ones of the side and bottom edges of the panels are secured together. The panels confront each other at the top portion of the package to form an interface through which the package may be filled. The top portion of the package is reinforced with reinforcing layers to form at least one top extension, which includes a handle for supporting the package.

16 Claims, 18 Drawing Sheets

(56) References Cited

U.S. PATENT DOCUMENTS

| | | | | |
|---|---|---|---|---|
| 6,355,732 | B1 | 3/2002 | Beer | |
| 7,494,279 | B2 * | 2/2009 | Marquet et al. | 383/10 |
| 7,665,894 | B2 * | 2/2010 | DeBlander et al. | 383/9 |
| 8,430,566 | B2 * | 4/2013 | Brauer et al. | 383/66 |
| 8,961,012 | B2 * | 2/2015 | Martin et al. | 383/10 |
| 2006/0021894 | A1 * | 2/2006 | Clark, Jr. | B65D 75/5833 206/440 |
| 2009/0110334 | A1 * | 4/2009 | Marquet | B65D 33/08 383/7 |
| 2011/0069908 | A1 * | 3/2011 | Wilkes | B65D 75/008 383/10 |
| 2013/0315507 | A1 * | 11/2013 | Teixido Vidal | B65D 33/08 383/10 |

* cited by examiner

FLEXIBLE PACKAGE WITH REINFORCED TOP AND METHOD OF FILLING THE SAME

CROSS-REFERENCE TO RELATED APPLICATIONS

This utility application claims the benefit under 35 U.S.C. §119(e) of Provisional Application Ser. No. 61/777,449, filed on Mar. 12, 2013 entitled Flexible Package With Folded Top And Method Of Filling And Sealing The Package With A Product, whose entire disclosure is incorporated by reference herein and which is assigned to the same assignee as the subject invention.

BACKGROUND OF THE INVENTION

This invention relates to flexible packages arranged to be carried or supported by a handle and more particularly to flexible packages having at least one handle for carrying the package and with the package having a large openable mouth to facilitate filling of the package.

Various flexible packages are available commercially for holding flowable materials therein and which include handles for carrying or otherwise lifting the package. Such packages are typically used for carrying heavy products, e.g., agricultural chemicals, etc. For example, current "stand-up" pouches employ typically handles that are cut in or otherwise provided in a side top corner of the pouch. In this orientation, the pouch hangs at an angle when carried. Such a pouch must be made longer to keep product from spilling after the top has been opened. Moreover, current stand-up pouches have smaller openings, due to the top area being dedicated to the corner handle.

Thus, a need exists for a package which overcomes the disadvantages of the prior art. The packages of this invention address that need.

SUMMARY OF THE INVENTION

One aspect of this invention is directed to a flexible package for holding a product therein. The package comprises a front panel, a rear panel and at least one reinforcing panel. The front and rear panels are secured together to define a hollow interior therebetween. Each of the panels is formed of a flexible sheet material. The front panel has a pair of side edge portions, a bottom edge portion, and a top edge portion. The rear panel has a pair of side edge portions, a bottom edge portion, and a top edge portion. Respective ones of the side edge portions of the front panel are secured to respective ones of the side edge portions of the rear panel. The bottom edge portion of the front panel is secured to the bottom edge portion of the rear panel, with at least one reinforcing panel being secured to the top edge portion of one of the front and rear panels to form a first top extension. The first top extension has a handle for carrying the package. The front and rear panels form an interface therebetween, with the interface being openable to provide access to the hollow interior to thereby enable the filling of the hollow interior with the product.

In accordance with one exemplary aspect of this invention the package additionally comprises a top panel. The top panel forms at least one reinforcing panel and is folded along a first fold line into a configuration comprising a V-shaped portion and pair of top edge portions located on opposite sides of the first fold line. One of the pair of top edge portions of the top panel is secured to the top edge portion of the rear panel to form a first top extension. The other of the pair of top edge portions of the top panel is disposed adjacent to the top edge portion of the front panel to form the interface.

In accordance with another exemplary aspect of this invention the V-shaped portion of the top panel comprises a portion of a W-shaped configuration, with the top panel being folded along the first fold line and along second and third fold lines to form the W-shaped configuration. The top edge portions of the top panel are located on opposite sides of the fold lines.

In accordance with another exemplary aspect of this invention one of the front and rear panels includes a line which is arranged to be cut to provide access to the product within the package after the hollow interior of the package has been filled with the product and the package sealed.

In accordance with another exemplary aspect of this invention the package includes a peelable seal located adjacent the interface.

In accordance with another exemplary aspect of this invention the package includes a press-to-close zipper located adjacent the interface.

In accordance with another exemplary aspect of this invention the at least one reinforcing panel comprises a first reinforcing panel and a second reinforcing panel. The first reinforcing panel is secured to the top edge portion of the front panel to form a first top extension, with the second reinforcing panel being secured to the top edge portion of the rear panel to form a second top extension. Each of the extensions has a handle for carrying the package.

In accordance with another exemplary aspect of this invention the package comprises a stand-up pouch. The stand-up pouch includes a bottom gusset panel formed of a flexible sheet material. The bottom gusset panel has a pair of edge portions, with one of said edge portions of the bottom gusset panel being secured to the bottom edge portion of the front panel and the other of the edge portions of the bottom gusset panel being secured to the bottom edge portion of the rear panel.

In accordance with another aspect of this invention the package may include a fitment to provide access to the product within the package after the package has been filled and sealed.

In accordance with another aspect of this invention there is provided a method of filling and sealing a flexible package. That method basically entails providing a package like that described above and opening the interface to provide a mouth for the package, introducing a product through the mouth into the hollow interior of the package and sealing the mouth closed to contain the product within the package.

DESCRIPTION OF THE DRAWING

FIG. 18 is a vertical sectional view of the pouch shown in FIG. 17 with the top left side extension of the pouch being opened to enable filling of the pouch;

FIG. 19 is a vertical sectional view of the pouch shown in FIG. 17 showing the pouch in the process of being filled with a product through the opened top;

FIG. 20 is a vertical sectional view of the pouch of FIG. 17 shown after it has been filled, but with its top still open ready to be sealed shut;

FIG. 23 is a vertical sectional view of the pouch shown in FIG. 22, as the left side extension is in the process of being removed, e.g., torn away;

FIG. 24 is a vertical sectional view of the pouch shown in FIG. 22 after it has been opened to provide access to the product within the pouch;

FIG. 41 is a vertical sectional view of the top portion of the pouch shown in FIG. 40 with the top left side extension of the pouch being opened to enable filling of the pouch;

FIG. 42 is a vertical sectional view of the top portion of the pouch shown in FIG. 40 showing the pouch in the process of being filled with a product through the opened top;

FIG. 43 is a vertical sectional view of the top portion of the pouch of FIG. 40 shown after it has been filled (the filled product not being shown), but with its top still open and ready to be sealed shut;

FIG. 44 is a vertical sectional view of the top portion of the pouch of FIG. 40 after the top of the pouch has been collapsed and sealed shut (the filled product not being shown);

DETAILED DESCRIPTION OF THE PREFERRED EMBODIMENT

Figures 1, 2:
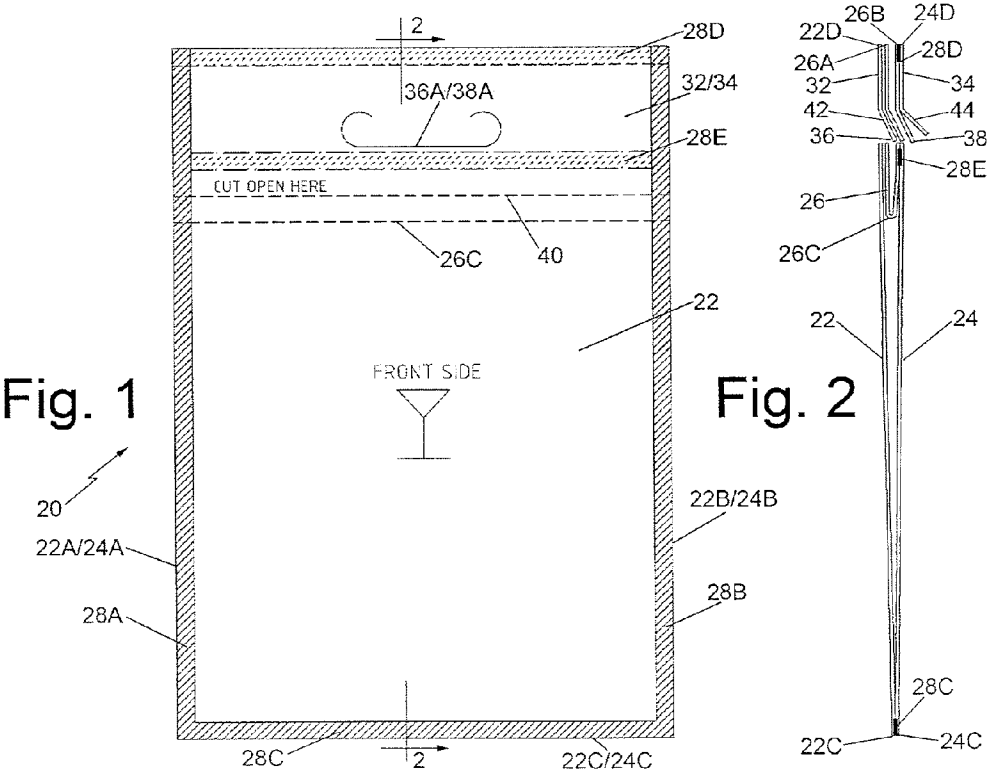
FIG. 1 is top plan view of one exemplary embodiment of a package constructed in accordance with this invention, e.g., a flat, rectangular shaped pouch, having a pair of upper or top extensions separated by a V-shaped top panel, with each of the top extensions including a handle and with the package being shown in its condition ready to be filled.
FIG. 2 is a sectional view taken along line 2-2 of FIG. 1.

Referring now to the various figures of the drawing wherein like reference characters refer to like parts, there is shown in FIG. 1 one exemplary embodiment of a package 20 constructed in accordance with one aspect of this invention. The package 20, like the packages of FIGS. 4-16 includes a folded top panel in a V-shaped configuration. Other packages constructed in accordance with this invention are shown in FIGS. 25-44 include a folded top panel in a W-shaped configuration. Those two folded top panel configurations will be described in detail later. Irrespective of whether the package makes use of a V-shaped top panel or a W-shaped top panel, the package can take various forms, e.g., a flat pouch or a stand-up pouch.

The package 20 of FIG. 1 is in the form of a flat pouch 20. That pouch is formed of a total of three sheets of any suitable flexible material(s), each of which may be in either a single ply or multiple plies. In particular, the pouch 20 includes a front panel 22, a rear panel 24, and a top panel 26. The front panel 22 and the rear panel 24 are of similar size and shape. In the embodiment shown in FIGS. 1 and 2, each panel 22 and 24 is of a rectangular shape and they overlie each other. The front panel 22 includes a pair of side edge portions 22A and 22B, a bottom edge portion 22C, and a top edge portion 22D. The rear panel 24 includes a pair of side edge portions 24A and 24B, a bottom edge portion 24C, and a top edge portion 24D. The top panel 26 is also of rectangular shape and has a width which is the same as the width of the front and rear panels 22 and 24. The side edge portions 22A and 24A are sealed together, e.g., welded, along a seal line 28A. The side edge portions 22B and 24B are sealed, e.g., welded, together along a seal line 28B. The bottom edge portions 22C and 24C are sealed, e.g., welded, together along a seal line 28C. Those sealed edge portions form a hollow interior 30 for receipt of some product P (FIG. 19) to be held within the package.

The top of the hollow interior 30 is closed by the top panel 26 to complete the package. To that end, the top panel 26 is folded into a V-shaped configuration having a pair of top edge portions 26A and 26B disposed on opposite sides of its fold line 26C. The top edge portion 26A of the panel 26 is disposed adjacent and confronting the top edge portion 22D of the panel 22 to form an interface therebetween which is openable, e.g., forms a mouth, for filling the package with the product P. The top edge portion 26B of the panel 26 is secured, e.g., welded, to the top edge portion 24D of the panel 24 along a seal line 28D. In addition, an intermediate portion of the panel 26 located between the fold line 26C and the top edge portion 26B is secured, e.g., welded, to the panel 24 along a transverse seal line 28E. Thus, the top portions of the panels 22 and 24 and their adjacent portions of the top panel 26 form a pair of top extensions 32 and 34. Those extensions include respective handles 36 and 38. The handles are in the form of openings created by cuts 36A/38A through the sheet material making up the top extensions, with the cuts 36A/38A being superimposed over each other as shown in FIG. 1. The portions of the top extensions 32 and 34 that are bounded by the cuts and located immediately below the top edges of the cuts are foldable out of the plane of the extensions 32 and 34 to form respective flaps 42 and 44 as shown in FIG. 2. The openings created by each of the flaps when folded out of the plane of their respective extension form an open handle through which the fingers of a person can be extended to carry the package by the handle. In the embodiment shown in FIGS. 1 and 2, each of the top extensions is formed of two thicknesses of sheet material. This provides a very strong arrangement for carrying a heavy, filled package.

The package 20 is arranged to filled with the product P (e.g., a flowable material, such as a liquid powder, granulated material, etc.) through the open interface or portal between portions 22A and 26A of the panels 22 and 26, respectively, and then sealed, in a manner similar to that which will be described later with respect to the stand-up package shown in FIG. 4. Access to the product P within the sealed package can be provided by removal of a top extension, e.g., by cutting or tearing it away along a transverse "cut" line 40 in the front panel 22. The cut line is arranged to be cut or torn along its entire length, i.e., the full width of the package 20, to sever the front panel along that line and also to sever the underlying portion of the top panel (as will be described later).

Figure 3:
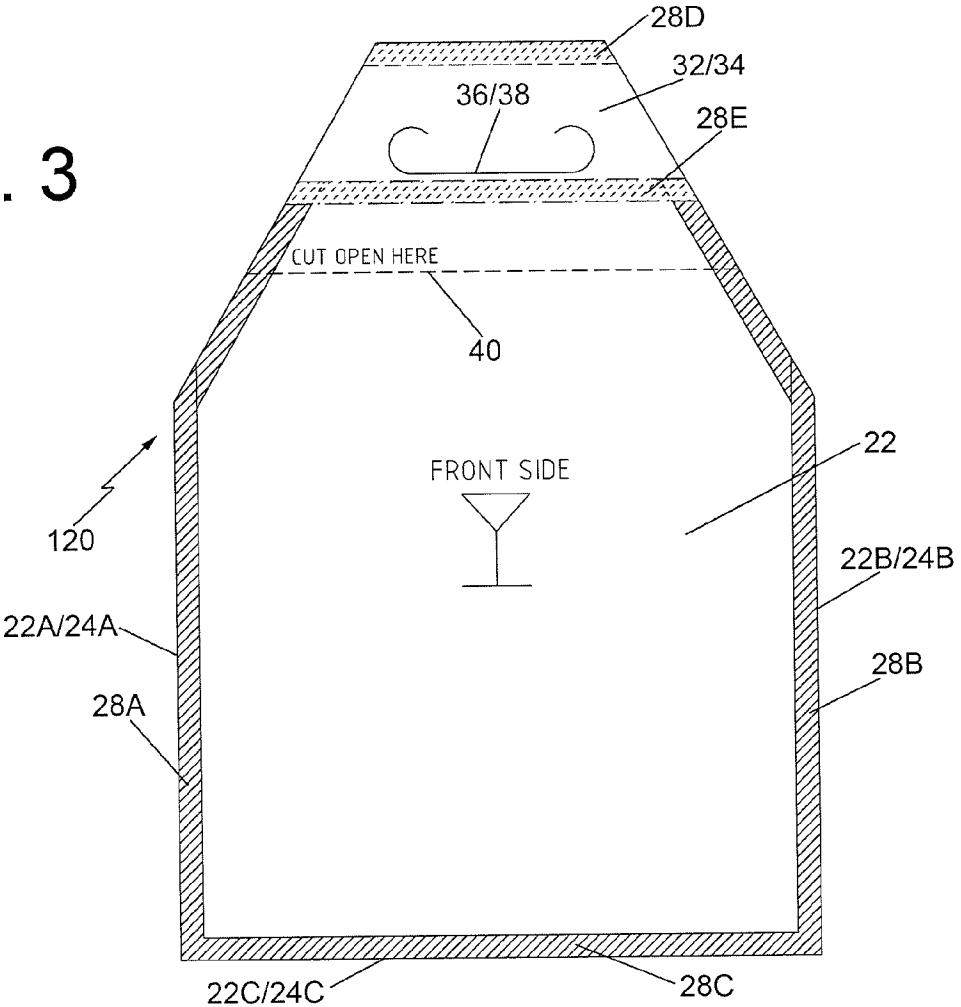
FIG. 3 is a plan view, similar to FIG. 1, but showing an alternative shape for the pouch of FIG. 1, i.e., a flat pouch having a tapered top.

The package 120 shown in FIG. 3 is similar in construction to the package 20 except that the front and rear panels are not rectangular, but rather include angularly cut-away upper corners so that the top extensions 32 and 34 are tapered. In the interest of brevity the common features of the packages 20 and 120 will be given the same reference characters and the details of their construction, arrangement and function will not be reiterated.

Figure 5:
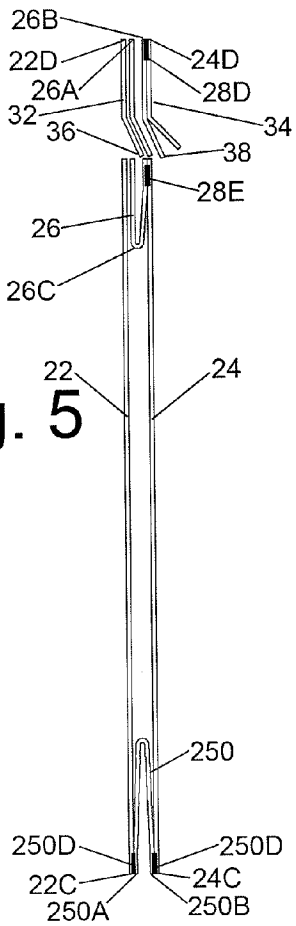
FIG. 5 is a sectional view taken along line 5-5 of FIG. 5.
Figure 4:
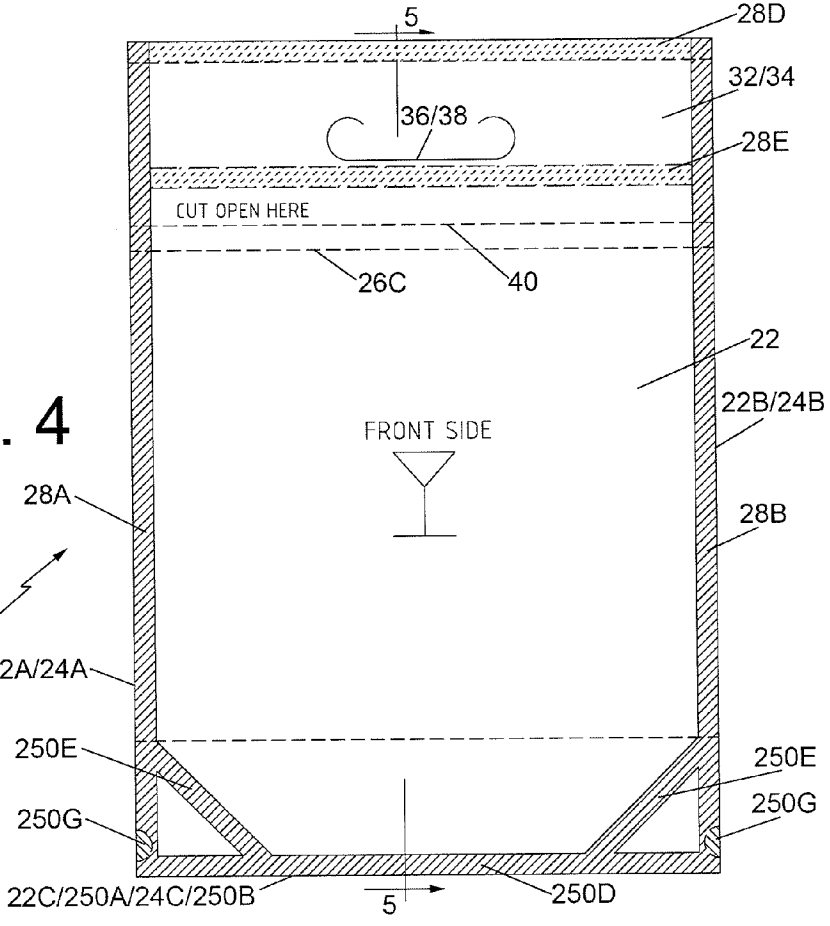
FIG. 4 is a plan view of another exemplary embodiment of a package including a V-shaped top panel constructed in accordance with this invention, e.g., a stand-up rectangular shaped pouch, having a pair of upper or top extensions, each including a handle, with the package being shown in its condition ready to be filled.

Turning now to FIGS. 4 and 5 there is shown another alternative embodiment of a flexible package 220 constructed in accordance with this invention. The package 220 is in the form of a stand-up pouch and it includes many of the same features as the flat pouch 20. Thus, in the interest of brevity the common features of the packages 20 and 220 will be given the same reference characters and the details of their construction, arrangement and function will not be reiterated. To that end, as can be seen in FIGS. 4 and 5 the package 220 includes a front panel 22, a rear panel 24 and a top panel 26 like that of the package 20. However, being a stand-up pouch the package 220 includes a bottom gusset panel 250, which is of the same width as the front and rear panels 22 and 24, respectively. The bottom gusset panel is arranged to be flattened when the pouch is filled to serve as the base on which the stand-up pouch can stand in a vertical orientation.

One edge portion 250A of the bottom gusset panel 250 is secured to the bottom edge portion 22C of the front panel 22 along a seal line 250D. In a similar manner the opposite edge portion 250B of the bottom gusset panel 250 is secured to the bottom edge portion 24C of the rear panel 24 along another seal line 250D. As is conventional the bottom gusset of the pouch 220 includes contoured seals at the bottom of the pouch. In particular, an angular seal line 250E secures the front panel 22 to the underlying portion of the gusset panel 250 between the seal lines 28A and 250D on one side of the package and a similar angular seal line 250F secures the front panel 22 to the underlying portion of the gusset panel 250 between the seal lines 28B and 250D on the opposite side of the package. In a similar manner an angular seal line like seal line 250E secures the rear panel 24 to the underlying portion of the gusset panel 250 between the seal lines 28A and 250D on one side of the package and a similar angular seal line like seal line 250F secures the rear panel 24 to the underlying portion of the gusset panel 250 between the seal lines 28B and 250D on the opposite side of the package. Conventional D-holes 250G are punched through the bottom gusset as shown in FIG. 4 to hold the bottom sides together.

Figure 19:
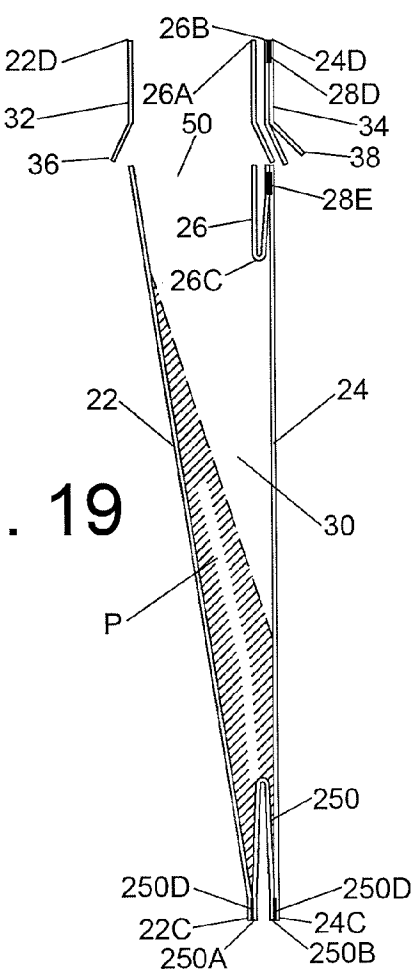
FIGS. 17-20 show the filling sequence of a stand-up pouch like in that of FIG. 4, with FIG. 17 being a vertical sectional view of the pouch shown its flat form ready to be filled and sealed.
Figure 18:
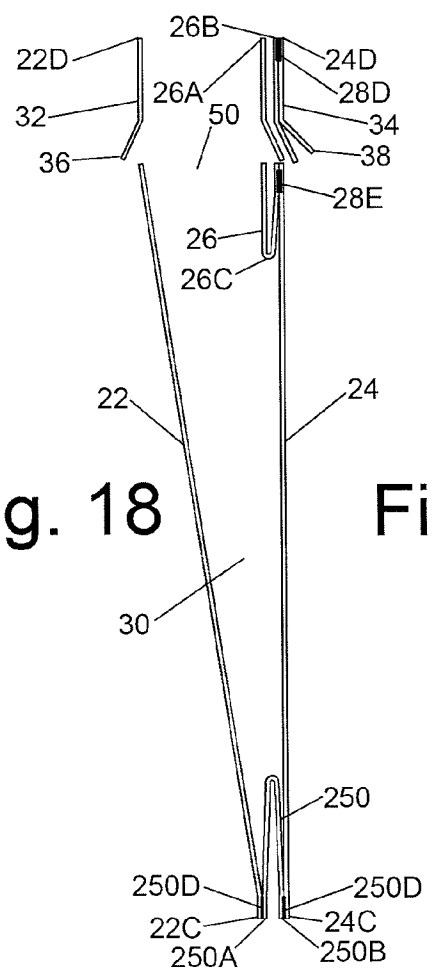
Figure 17:
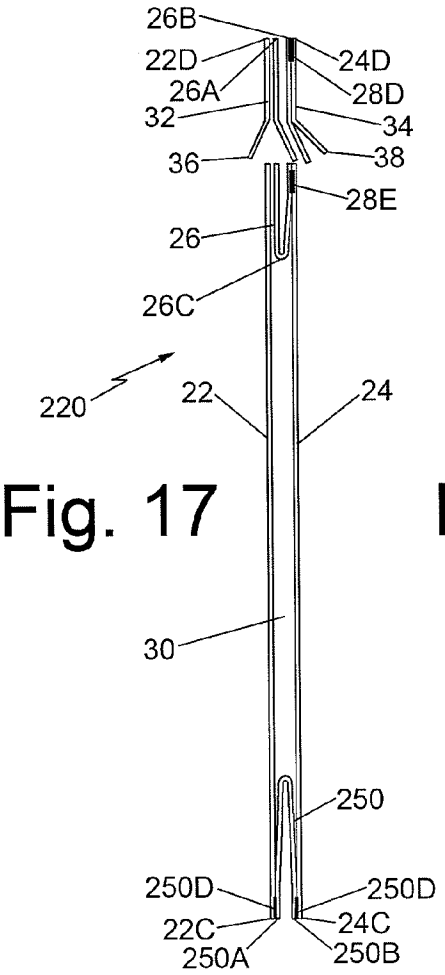
Figure 21:
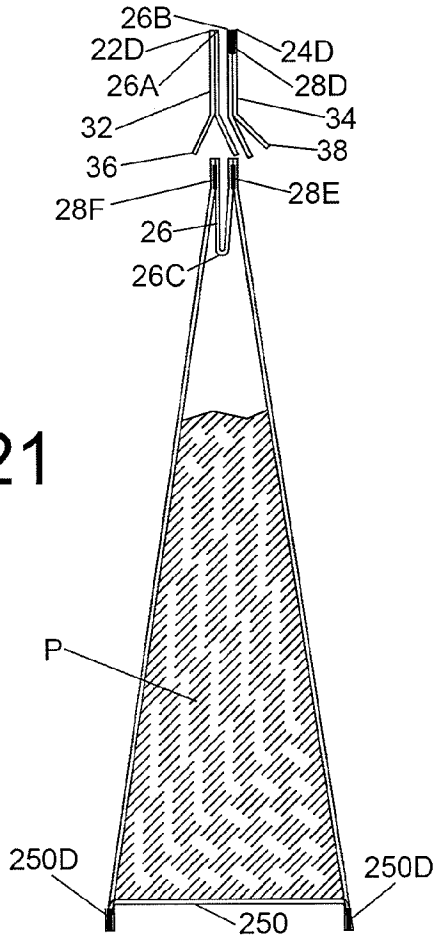
FIG. 21 is a vertical sectional view of the pouch of FIG. 17 after the top of the pouch has been collapsed and sealed shut.
Figure 20:
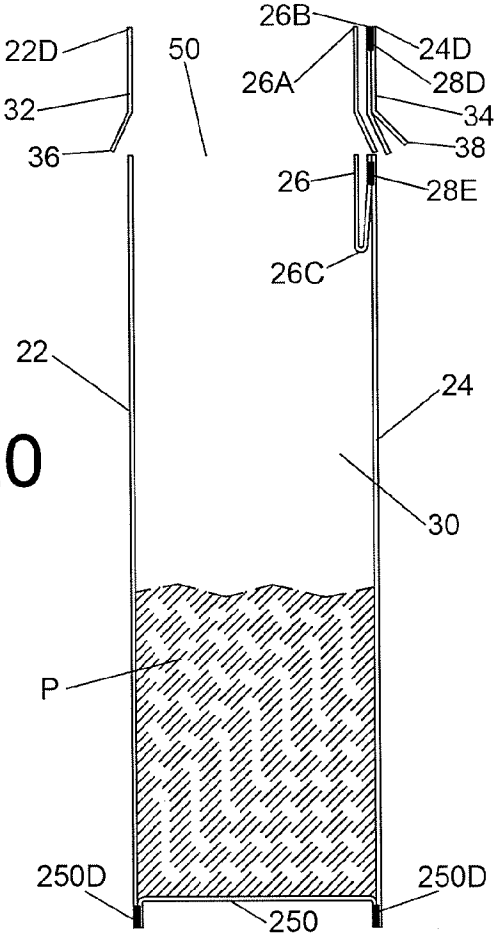

Turning now to FIGS. 17-21, the manner of filling and sealing the stand-up pouch 220 of FIG. 4 will now be described. To that end, the openable interface, i.e., the space between the top edge portion 22D of the front panel 22 and top edge portion 26A of the top panel 26 of a finished stand-up pouch, is opened from the state shown in FIG. 17 to the state shown in FIG. 18, thereby creating large (full package width) open mouth 50 through which the product P can be introduced into the package's interior. FIG. 19 shows the product P in the process of being introduced through the mouth 50 into the hollow interior space 30 of the package. Once the package is filled to its desired level the front panel 22 and the rear panel 24, with the top panel secured thereto, are moved towards each other to bring the portion of the front panel 22 just below the handle 36 into engagement with the portion of the top panel located at the same distance from the fold line 26C as the heat seal line 28E as shown in FIG. 21. At that time those confronting portions can be sealed, e.g., thermally welded or otherwise fixedly secured, together along a transverse seal line 28F, thereby sealing the product P within the pouch 220.

Figures 22, 23, 24:
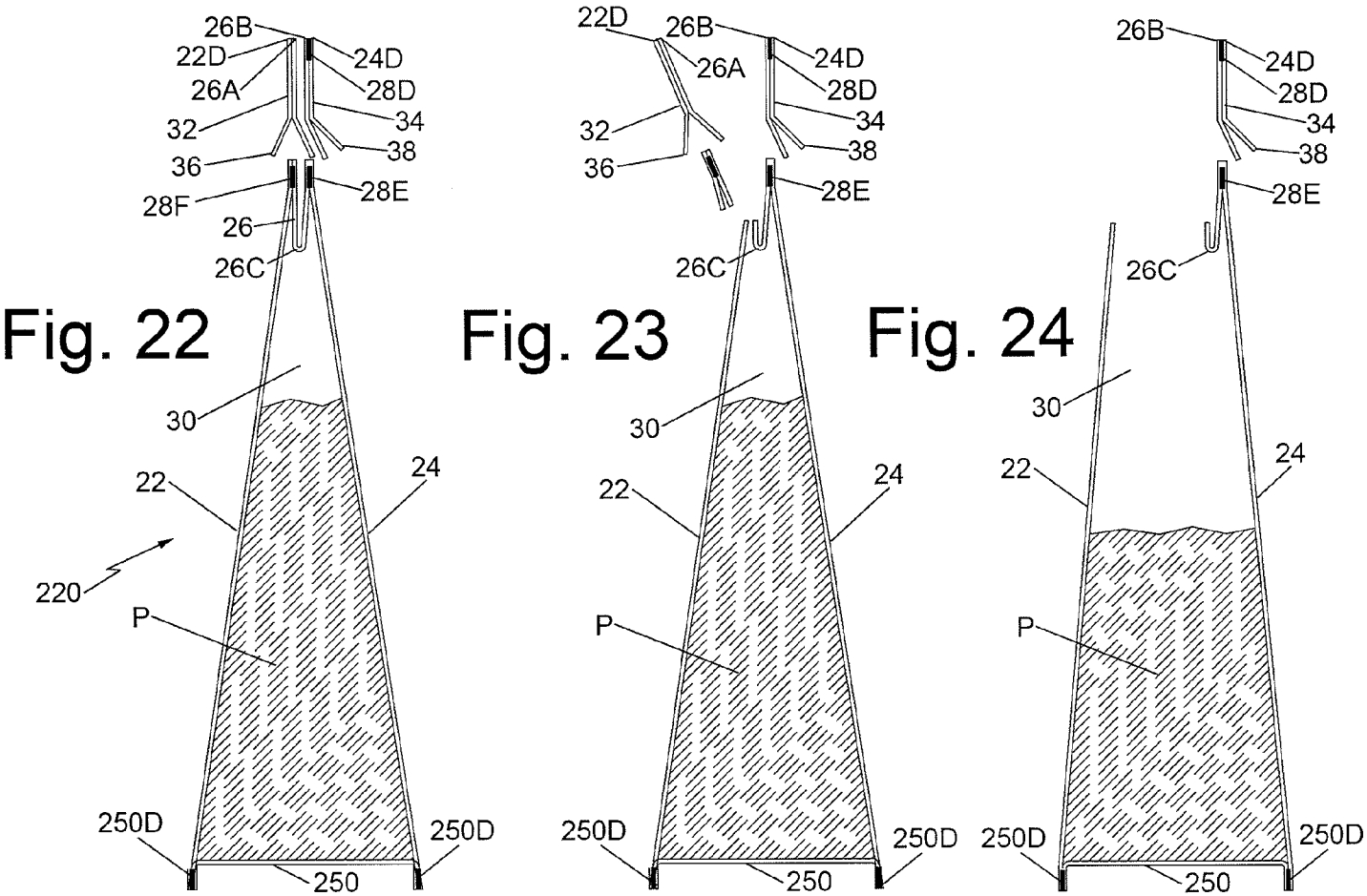
FIG. 22-24 show the sequence for opening a filled stand-up pouch, with FIG. 22 being a vertical sectional view of the pouch shown in FIG. 21 filled and ready to be opened to provide access to the product within the pouch.

The lifting or carrying of the pouch can be readily accomplished by pushing on the portions of the panels contiguous with the handles 36 and 38 to bend those portions of the panels out of their normal plane and thereby form open handles. Since there will be two open handles, with each handle being formed of two sheets of the flexible packaging material, the pouch 22 is suitable for holding relatively heavy products, e.g., 4 liters of liquid, without risk of breakage, Removal of all or a portion of the product P from a pouch like shown in FIG. 22 can be readily accomplished by removing the top extension 32. This can be accomplished by cutting, tearing or otherwise severing the pouch's front panel 22 and underlying portion of the top panel 26 along the transverse cut line 40 which is located below the seal line 28F as shown in FIG. 23. If desired each of the ends of the cut line 40 may include a respective notches 454 (FIG. 7) to facilitate tearing the package open along the line 40. Once the top extension 32 has been removed, the front panel of the package can then be pulled away from the rear panel 24 to provide a large access opening for access to the product P as shown in FIG. 24. At this time there still will be the handle 38 located in the top extension 34 available to facilitate lifting and carrying of the opened package, should such action be desired, e.g., if less than the entire contents of the package are removed from it.

As should be readily appreciated since each of the handles 36 and 38 of the package is centered, when the package is carried by both of those handles when the package is closed, or by a single handle after the package has been opened, the package will naturally assume a balanced vertical orientation. This feature is of considerable importance, particularly if the package has been opened with some or all of its contents remaining in the package, since the vertical orientation of the package when carried should minimize the risk of spillage from the opened package.

Figure 6:
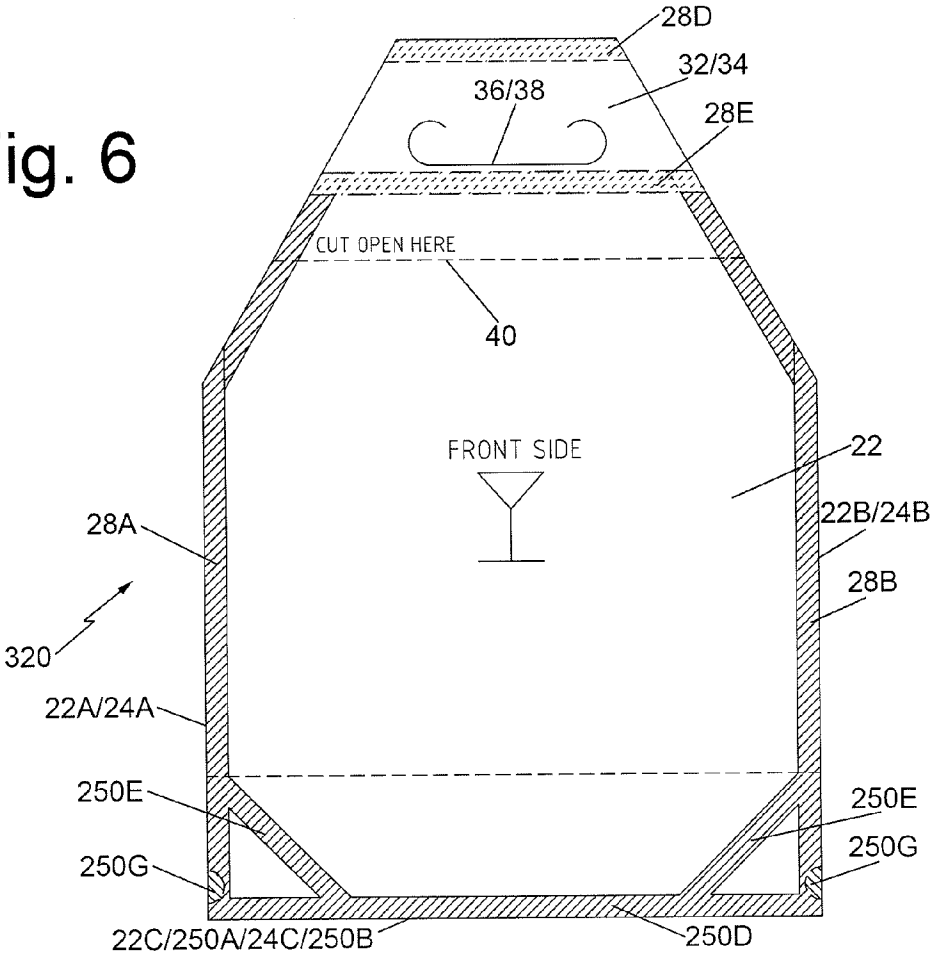
FIG. 6 is a plan view, similar to FIG. 4, but showing an alternative shape for the stand-up pouch of FIG. 4, i.e., a stand-up pouch whose top extensions are tapered.

The package 220 shown in FIG. 6 is similar in construction to the package 220 except that the front and rear panels are not rectangular, but rather include angularly cut-away upper corners to form tapered top extensions 32 and 34. Thus, in the interest of brevity the common features of the packages 220 and 320 will be given the same reference characters and the details of their construction, arrangement and function will not be reiterated.

Figure 8:
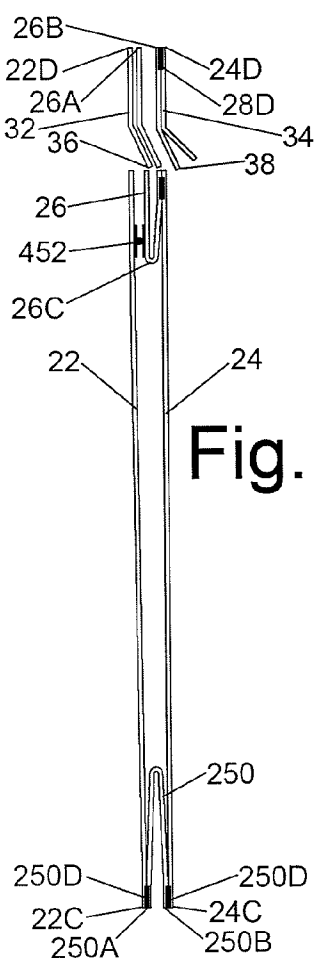
FIG. 8 is a sectional view taken along line 8-8 of FIG. 7.
Figure 7:
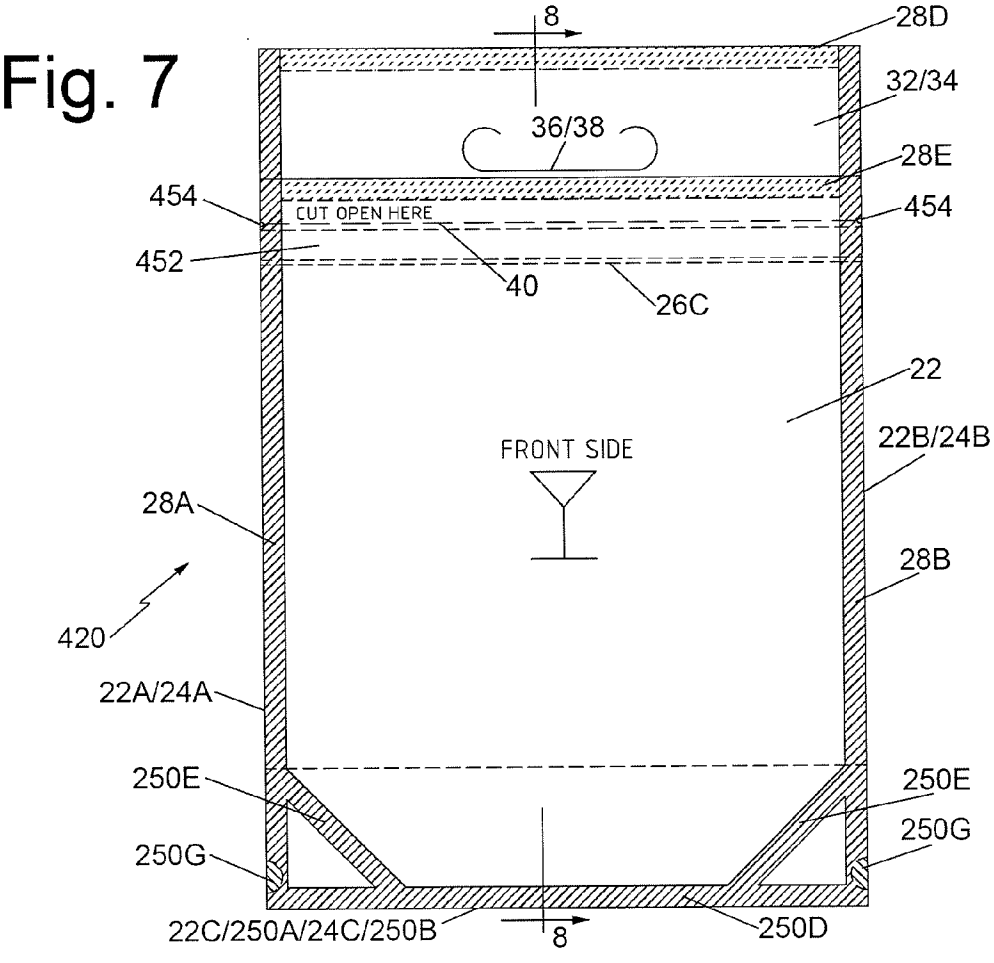
FIG. 7 is a plan view of another exemplary embodiment of a stand-up pouch constructed in accordance with this invention like that of FIG. 4 and which includes a press-to-close zipper in one of its top extensions, with the pouch shown in its condition ready to be filled.

FIGS. 7 and 8 show still another alternative embodiment of a stand-up pouch 420 constructed in accordance with this invention. The pouch 420 is similar to the pouch 220; however the pouch 420 includes a releasably securable connector which when opened forms a mouth to provide access to the interior of the package. Inasmuch as the pouch 420 is similar to the pouch 220 the common features of the packages 220 and 420 will be given the same reference characters and the details of their construction, arrangement and function will not be reiterated. To that end, as can be seen in FIG. 7 the top edge portion 22D of the front panel 22 terminates just below the handle 36. Thus, the two top extensions 32 and 34 are made up of four layers of flexible sheet material. The releasably securable connector, in this case a press-to-close zipper 452, is located at the interface of the inner surface of the front panel 22 just below the top edge portion 22D and the outer surface of the top panel 26 adjacent the fold line 26C. In particular, one component of the zipper 452 is secured to the inner surface of the front panel, while the cooperating component of the zipper 452 is secured to the outer surface of the top panel adjacent the fold line 26C.

The pouch 420 can be filled by opening the zipper 452 and introducing the product P into the hollow interior 30. Once that has been accomplished, the front panel 22 is sealed to the confronting portion of the top panel along seal line 28F in a manner like that described above. The seal line 28F is aligned with the seal line 28E and is located above the zipper 452 and above the cut line 40. A pair of tear-notches 454 is provided in the panels 22 and 24 at the respective ends of the cut line 40. Thus to initially open the pouch after it has been filled and sealed, the package is cut or torn along the cut line 40 to remove the top extension 32. The presence of the zipper 452 at the interface of the front panel 22 and the top panel 26 enables the pouch 420 to be reopened and reclosed when desired after the package's initial opening.

Figure 10:
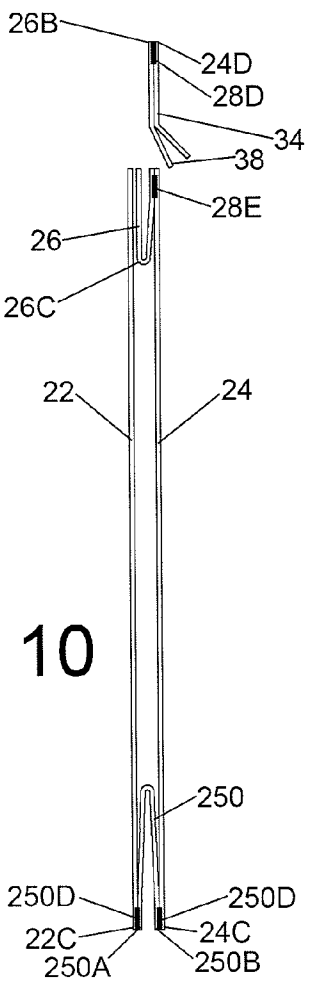
FIG. 10 is a sectional view taken along line 10-10 of FIG. 9.
Figure 9:
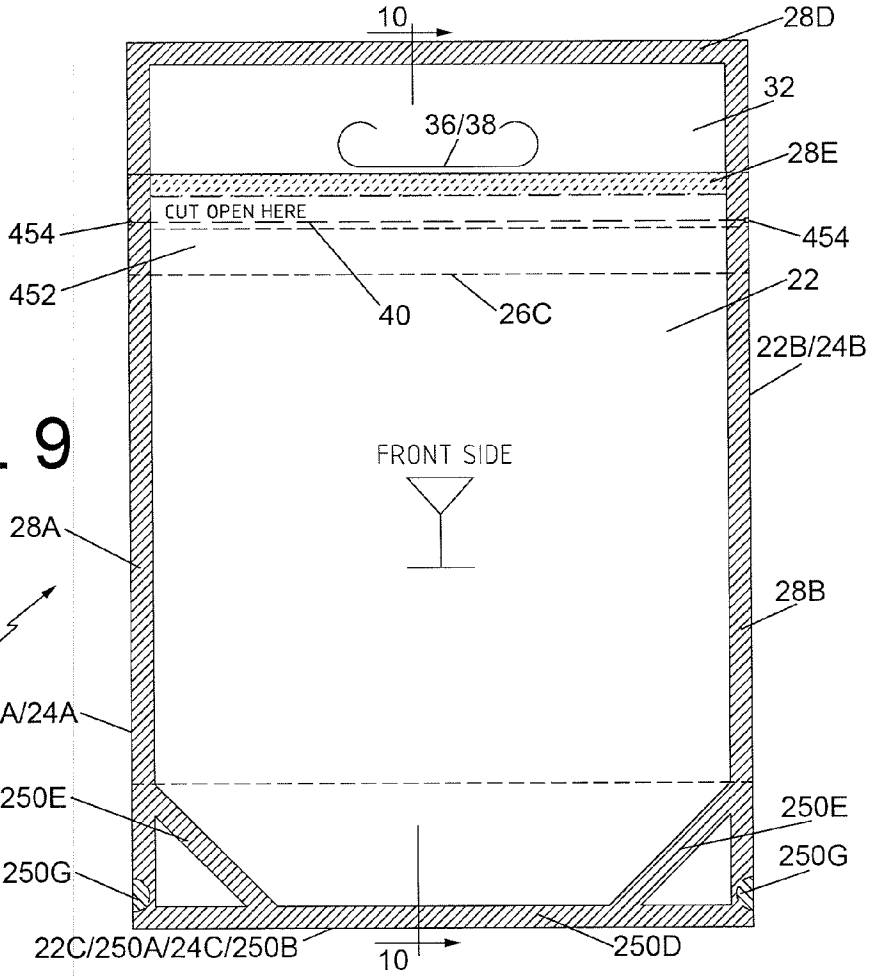
FIG. 9 is a plan view of another exemplary embodiment of a stand-up pouch constructed in accordance with this invention and similar to FIG. 4, but with the stand-up pouch including a single top extension with a handle, with the pouch shown in its condition ready to be filled.

FIGS. 9 and 10 shows yet another alternative embodiment of a stand-up pouch 520 constructed in accordance with this invention. The pouch 520 is similar to the pouch 420 except that the pouch includes only a single top extension, i.e., the extension formed by the upper end of the rear panel 24 and the adjacent portion of the top panel 26. In addition, the pouch does not include the press-to-close zipper. Inasmuch as the pouch 520 is similar to the pouch 420 the common features of the packages 520 and 420 will be given the same reference characters and the details of their construction, arrangement and function will not be reiterated.

The filling of the pouch 520 is accomplished by pulling the top edge portion of the front panel 22 away from the underlying portion of the top panel 26 to create a wide mouth through which the product P may be introduced into the pouch. Once that has been accomplished the pouch can be sealed in a manner similar to that discussed above with respect to the pouch 420 of FIG. 8, i.e., heat sealing the top edge portion of the front panel 22 to the underlying portion of the top panel adjacent its top edge 26A to form the seal line 28F. The opening of the pouch 520 is accomplished in the same manner as described above with respect to the pouch 420 of FIG. 8

Figure 12:
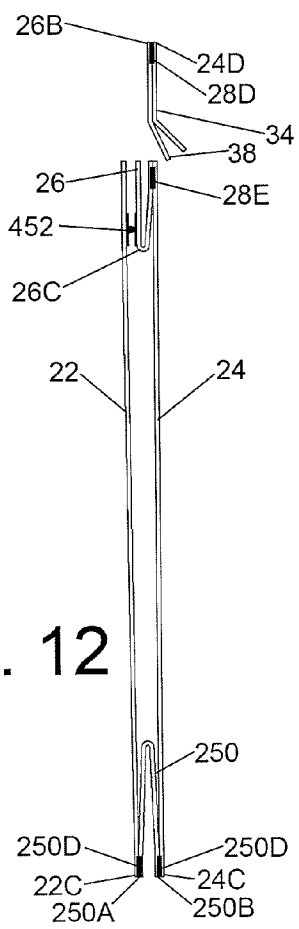
FIG. 12 is a sectional view taken along line 12-12 of FIG. 11.
Figure 11:
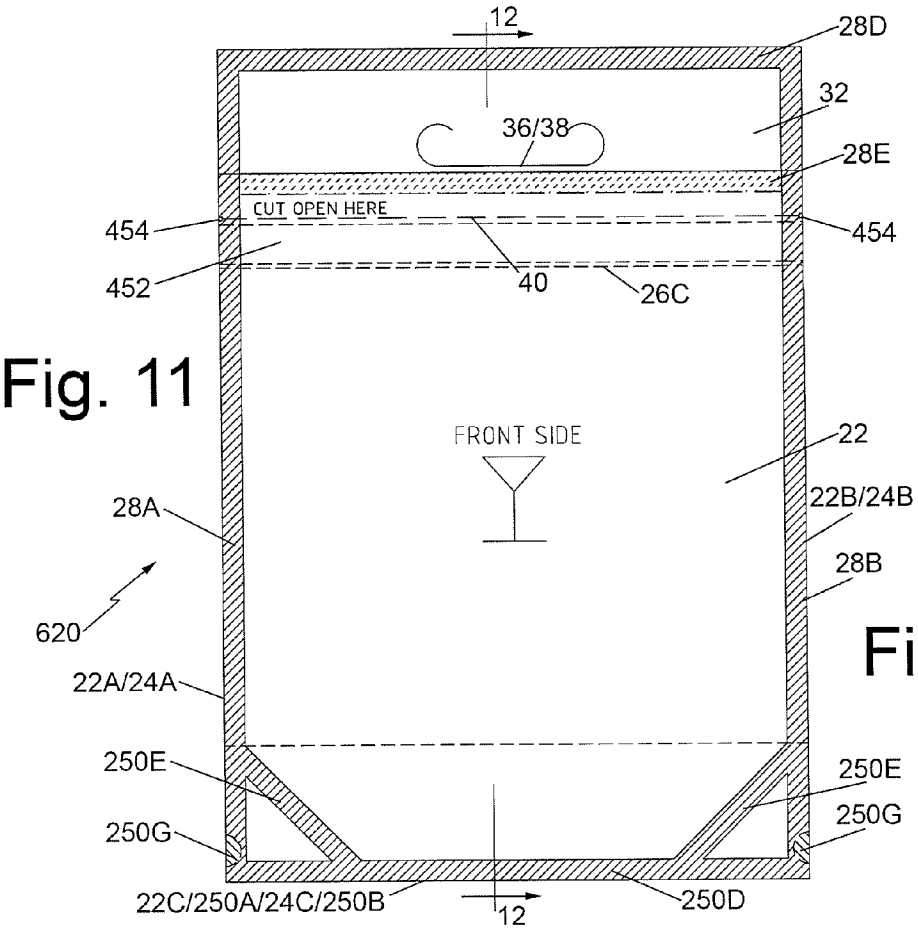
FIG. 11 is a plan view of another exemplary embodiment of a stand-up pouch constructed in accordance with this invention like that of FIG. 9 and which includes a press-to-close zipper at the V-shaped top panel, with the pouch shown in its condition ready to be filled.

FIGS. 11 and 12 shows yet another alternative embodiment of a stand-up pouch 620 constructed in accordance with this invention. The pouch 620 is similar to the pouch 520 except that it also includes the releasably securable connector, e.g., the press-to-close zipper 452, interposed between the top edge portion of the front panel and the portion of the top panel 26 adjacent the fold 26C. Inasmuch as the pouch 620 is similar to the pouch 520 the common features of the packages 520 and 620 will be given the same reference characters and the details of their construction, arrangement and function will not be reiterated. Like the pouch 420, the pouch 620 is arranged to be filled by opening its zipper 452 and pulling the front panel 22 away from the underlying portion of the top panel 26 and then sealed as discussed above. Opening of the sealed package is accomplished by cutting or tearing of the package along the cut line 40 in the same manner as described above.

Figure 14:
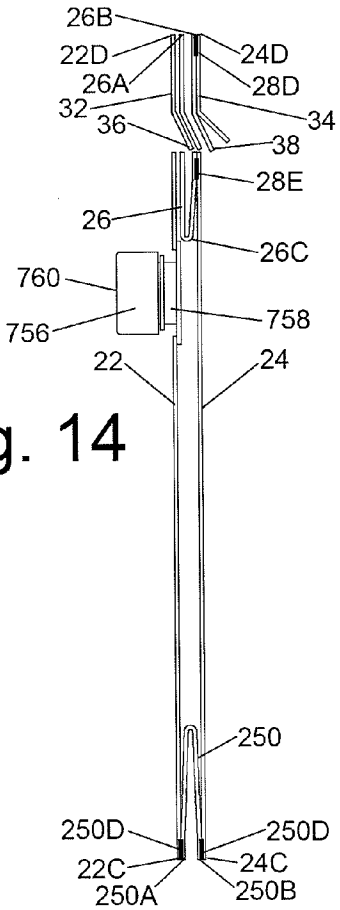
FIG. 14 is a sectional view taken along line 14-14 of FIG. 13.
Figure 13:
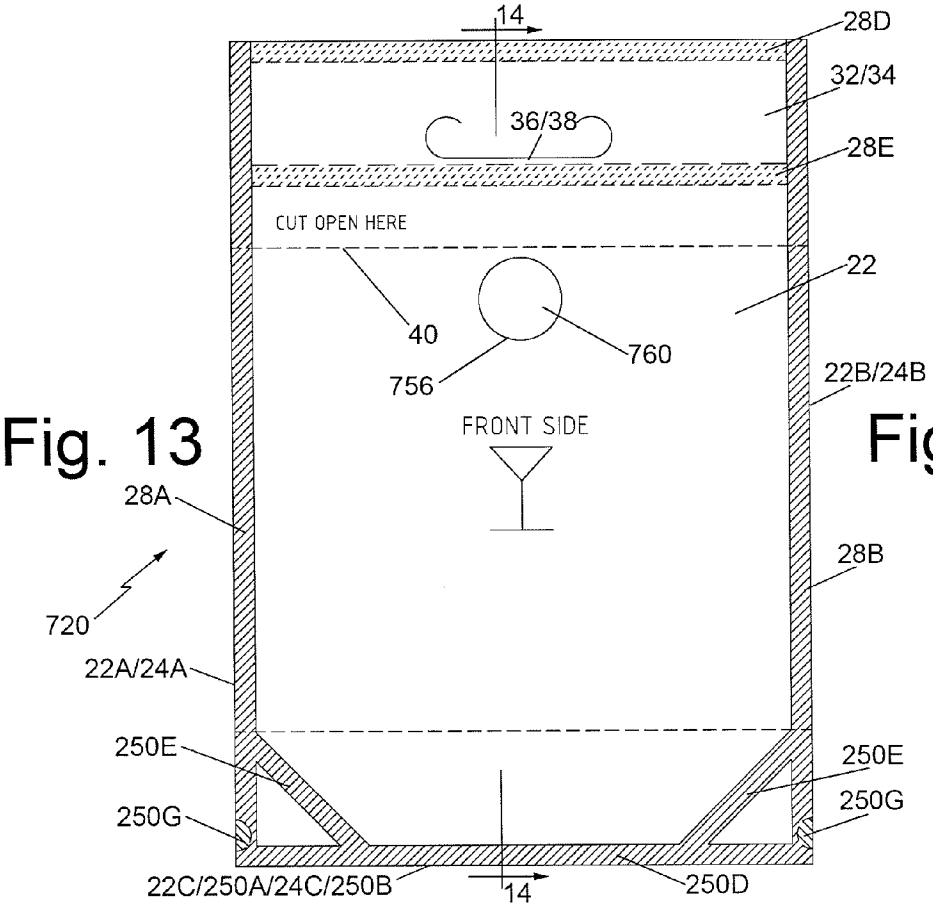
FIG. 13 is a plan view of another exemplary embodiment of a package constructed in accordance with this invention like that of FIG. 4 but including a pour spout fitment and associated cap mounted on the front panel of the pouch, with the pouch shown in its condition ready to be filled.

FIGS. 13 and 14 shows yet another alternative embodiment of a stand-up pouch 720 constructed in accordance with this invention. The pouch 720 is similar to the pouch 220 except that it includes a fitment 756 secured to the front panel 22. The fitment 756 is in the form of an injection molded spout having a flanged base and a cap to close the spout. The flange of the spout is fixedly secured, e.g., welded, to the front panel 22 on either the inside (such as shown) or on the outside of that panel, so that the passageway in the fitment is in communication with the hollow interior 30 of the pouch. Inasmuch as the pouch 720 is similar to the pouch 220 the common features of the pouch 720 and 220 will be given the same reference characters and the details of their construction, arrangement and function will not be reiterated.

As should be appreciated by those skilled in the art, the inclusion of the fitment 756 enables the product within the pouch to be dispensed. In this connection supporting the pouch by its handles enables the pouch to be tilted so that the product can be readily poured out of the pouch through the fitment after the fitment's cap has been removed. The fitment can take various configurations for various dispensing operations. For example, the fitment can be threaded to enable a common trigger-activate spray nozzle to be connected to the fitment and the pouch conveniently carried to dispense products, such as a household insecticide. For this type of dispensing the fitment's cap is removed and the spray cap and tube connected to the fitment. The handles of the pouch allow easy portability while spraying and dispensing the product.

Figure 16:
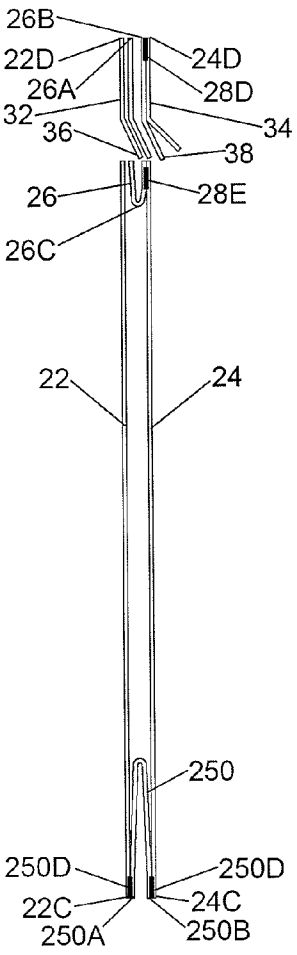
FIG. 16 is a sectional view taken along line 16-16 of FIG. 15.
Figure 15:
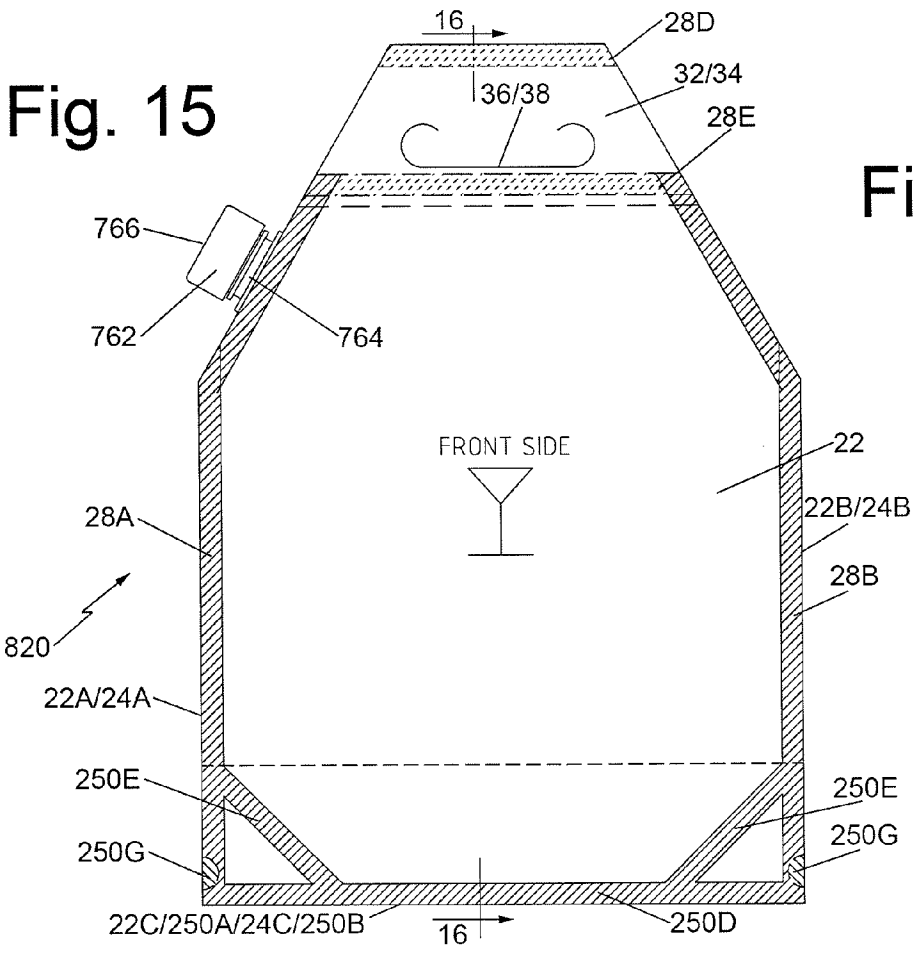
FIG. 15 is a plan view of another exemplary embodiment of a package constructed in accordance with this invention like that of FIG. 6 but including a pour spout fitment and associated cap mounted in one corner edge seal at the top of the pouch, with the pouch shown in its condition ready to be filled.

FIGS. 15 and 16 show yet another alternative embodiment of a stand-up pouch 820 constructed in accordance with this invention. The pouch 720 is similar to the pouch 320 except that it includes a fitment 762 secured between the front panel 22 and the rear panel 24 at the seal line along one of the angled corners of the pouch. The fitment 762 is in the form of an injection molded spout 764 having a boat-shaped base (not shown). A screw cap 766 is provided to close the spout. The boat-shaped based is arranged to be interposed between the panels and fixedly secured thereto. The boat shaped base has an opening in communication with the passageway in the fitment so that the passageway is in communication with the hollow interior 30 of the pouch. Inasmuch as the pouch 820 is similar to the pouch 320 the common features of the pouch 820 and 320 will be given the same reference characters and the details of their construction, arrangement and function will not be reiterated. The inclusion of the fitment 762 enables the contents of the pouch 820 to be poured or otherwise extracted from the interior of the pouch through the fitment once its cap has been removed.

Figure 26:
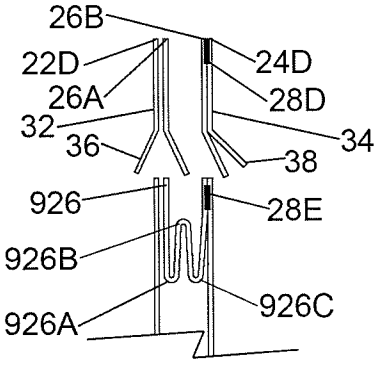
FIG. 26 is a sectional view of the top portion of the package of FIG. 25 taken along line 26-26 of FIG. 25.
Figure 25:
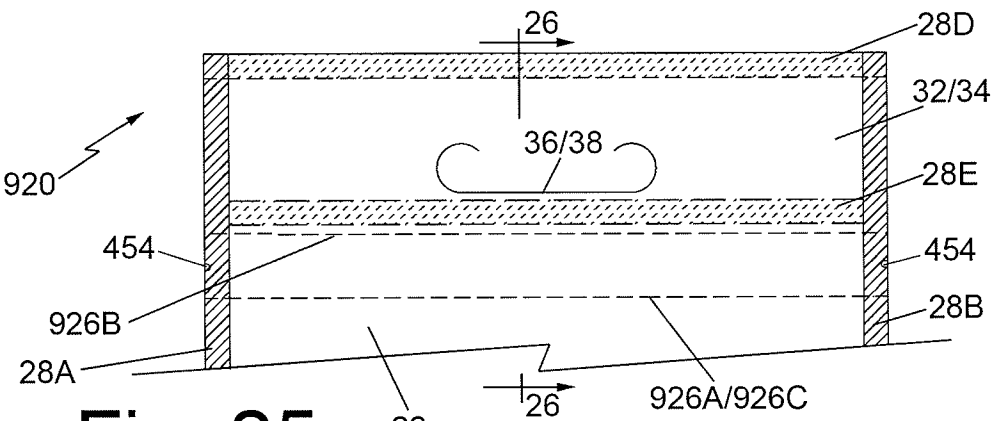
FIG. 25 is a top plan view of the top portion of a one exemplary embodiment of a package which is constructed similarly to the package of FIG. 4, except that its pair of top extensions are separated by a W-shaped top panel, with each of the top extensions including a handle, and with the package being shown in its condition ready to be filled.

Turning now to FIGS. 25 and 26, one exemplary embodiment of a flexible package 920 making use of a W-shaped top panel will now be described. The pouch 920 offers the same benefits as the packages with the "V-shaped" top panels discussed above. However, the "W-shaped" top panel provides some additional functional benefits to the user of the package. In particular, the center of the "W-shaped" to panel provides a location to readily access the contents of the package. Many ways of accessing the package's contents via the W-shaped top panel are possible and will be discussed below. In particular, methods of accessing the contents include: tearing or cutting away the entire center portion of the top panel by hand, facilitated by a tear notch, and tearing or cutting away a portion of the center portion of the top panel to create a restricted opening. In addition, the package can make use of a press-to-close zipper to add recloseability to the tear or cut-open area;

The exemplary package 920 is similar in all respects to the package 220 shown in FIG. 4, except for the construction of the top panel 926, i.e., the package 920 includes a W-shaped top panel in lieu of a V-shaped top panel. In the interest of brevity the common features of the pouches 220 and 920 will be given the same reference characters and the details of their construction, arrangement and function will not be reiterated. Thus, as best seen in FIG. 26 the top panel 926 basically comprises what can be thought of as two V-shaped portions that are connected together to form a W-shaped configuration. In particular, the sheet of flexible material making up the top panel 926 is folded along three fold lines 926A, 926B and 926C. The fold line 926B is interposed between the fold lines 926A and 926C. The sheet material of the top panel on both sides of the fold line 926A and contiguous therewith forms one V-shaped configuration, while the sheet material of the top panel on both sides of the fold line 926C and contiguous therewith forms the other V-shaped configuration, with those two V-shaped configurations being joined at the fold line 926B. The top edge portion 26A of the top panel 926, which is located adjacent the fold line 926A, is disposed adjacent and confronting the top edge portion 22D of the panel 22 to form an interface or portal therebetween. The interface is openable to form a mouth for filling the package 920 with the product P. The top edge portion 26B of the top panel 926, which is located adjacent fold line 926C, is secured to the top edge portion 24D of the rear panel 24 along transverse seal line 28D. In addition, a portion of the top panel 926 located between the fold line 26C and the top end portion 26B is sealed to the rear panel 24 along a transverse seal line 28E.

The filling and sealing of the product within the pouch 920 is accomplished in a similar manner to that described above with respect to pouch 220.

The top portions of the panels 22 and 24 and their adjacent portions of the top panel 926 form the pair of top extensions 32 and 34. Those extensions include respective handles 36 and 38 which are in the form of cuts through the sheet material making up the top extensions. Thus, each of the top extensions is formed of two thicknesses of sheet material.

Removal of the contents of the pouch 920 is effected through the top panel 926. To that end, the center portion of the "W" fold, i.e., the portion of the top panel contiguous with the center fold 926B is arranged to be torn or cut open to provide access to the interior of the pouch. To facilitate such action a pair of tear notches 454 is provided in the side edges of the top panel 926. Thus, when the center portion of the top panel has been torn away to provide an opening to the interior of the package, each of the two top extensions 32 and 34 will be intact so that both handles 36 and 38 remain available thr carrying the pouch.

Figure 27:
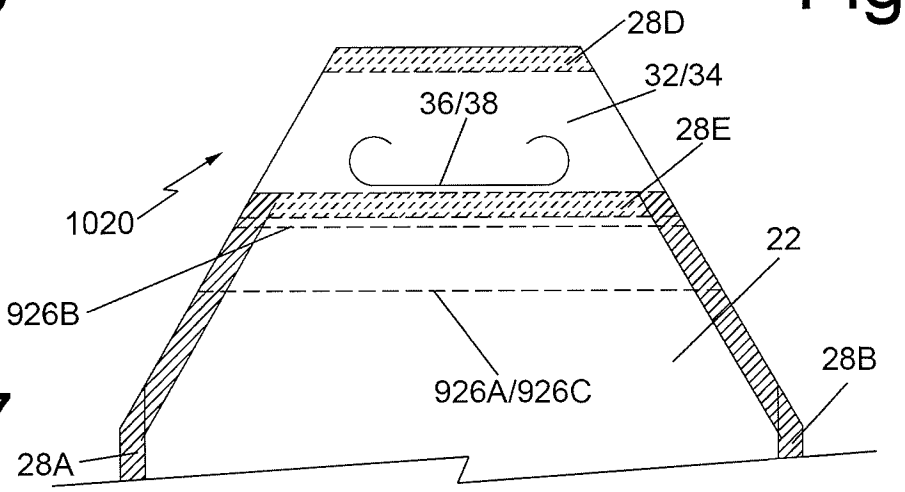
FIG. 27 is a top plan view, similar to FIG. 25, but showing an alternative shape for the pouch of FIG. 25, i.e., a flat pouch having a tapered top to form a pair of tapered top extensions.
Figure 28:
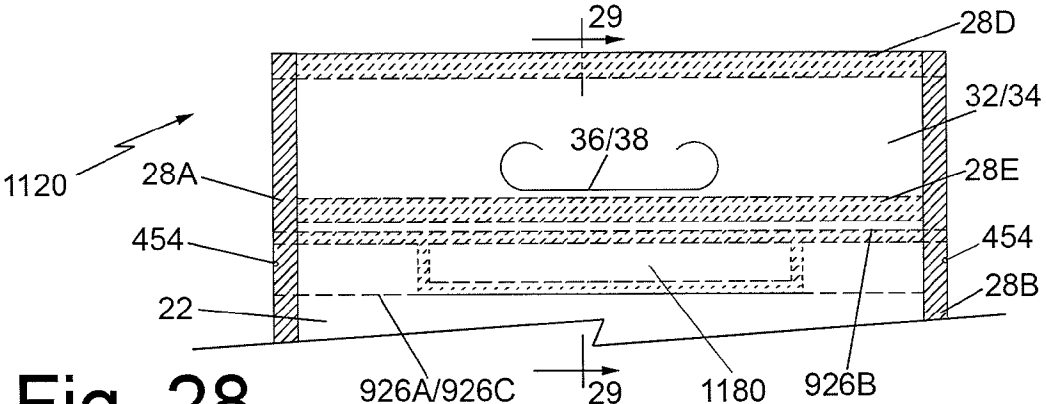
FIG. 28 is a plan view of the top portion of another exemplary embodiment of a package constructed like the package of FIG. 24 with the center portion of the W-shaped top panel including a restricted opening or spout which can be torn or cut open to enable the product to be dispensed from the package.

FIGS. 27 and 28 show a variant of the pouch of FIG. 25. In particular, the pouch 1020 shown in FIG. 27 includes a top portion that is tapered to form a pair of tapered extensions 32 and 34. All other features of the pouch 1020 are the same as the pouch 920 and hence will be given the same reference characters and the details of their construction, arrangement and function will not be reiterated in the interest of brevity.

It should be point out at this juncture that all of the W-shaped top panel embodiments of this invention, as well as all of the V-shaped top panel embodiments of this invention, can be Ruined to have square tops, like the embodiment 920, or tapered tops, like the embodiment 1020. Moreover, the packages of this invention can be formed as flat pouches or stand-up pouches.

Figure 29:
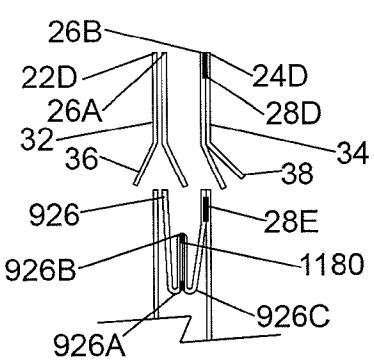
FIG. 29 is a sectional view taken along line 29-29 of FIG. 28.

Turning now to FIGS. 28 and 29, there is shown a pouch 1120 which is an alternative embodiment of the pouch 920. The top panel 926 of the pouch 1120 is constructed to enable the user to form a restricted opening or spout adjacent either side edge of the pouch and through which the contents of the pouch can be dispensed, e.g., poured. To that end, a shaped seal 1180 is proved in the center section of the top panel 926, i.e., the portions of the top panel 926 contiguous with the center fold line 926B. The shaped seal 1180 is located between a pair of tear notches 454, which are located in the side edges of the central portion of the top panel. Thus, the user can tear or cut a filled pouch 1120 by separating the top extensions 32 and 34 to expose the center section of the top panel 926 and then tear that section away starting from either of the tear notches 454 to create a restricted pour spout. All other aspects of the pouch 1120 are the same as the pouch 920 and hence will be given the same reference characters and the details of their construction, arrangement and function will not be reiterated in the interest of brevity.

Figure 31:
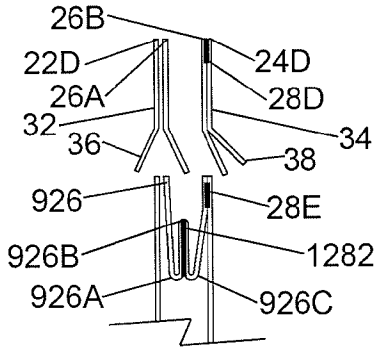
FIG. 31 is a sectional view taken along line 31-31 of FIG. 30.
Figure 30:
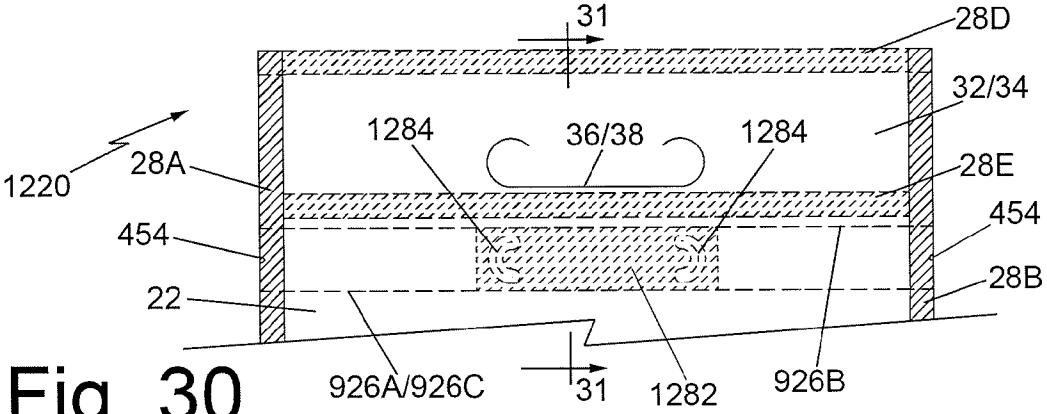
FIG. 30 is a plan view of the top portion of another exemplary embodiment of a package constructed like the package of FIG. 24 with the center portion of the W-shaped top panel including an alternatively constructed restricted opening or spout which can be torn open to enable the product to be dispensed from the package after it has been filled and sealed.

Turning now to FIGS. 30 and 31, there is shown a pouch 1220 which is an alternative embodiment of the pouch 1120. In this regard, the center portion of the top panel also includes a shaped seal 1282. However, the shaped seal 1282 includes the addition of a pair of "C" shaped cuts 1284 that are in alignment with the tear notches 454. Like the pouch 1120, the pouch 1220 is intended to be torn open by hand. The "C" cuts 1284 provide a stopping point for the tear. Moreover, the piece or portion of the pouch that is torn away to create the spout will remain fixed to the pouch. This action eliminates the possibility of the small portion of packaging material contaminating the product, or causing litter. All other aspects of the pouch 1220 are the same as the pouch 1120 and hence will be given the same reference characters and the details of their construction, arrangement and function will not be reiterated in the interest of brevity.

Figure 33:
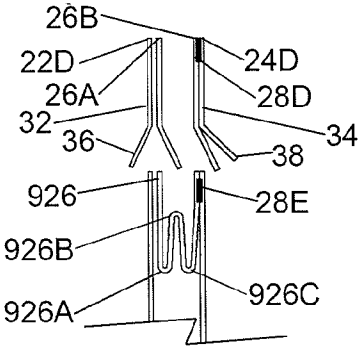
FIG. 33 is a sectional view taken along line 33-33 of FIG. 32.
Figure 32:
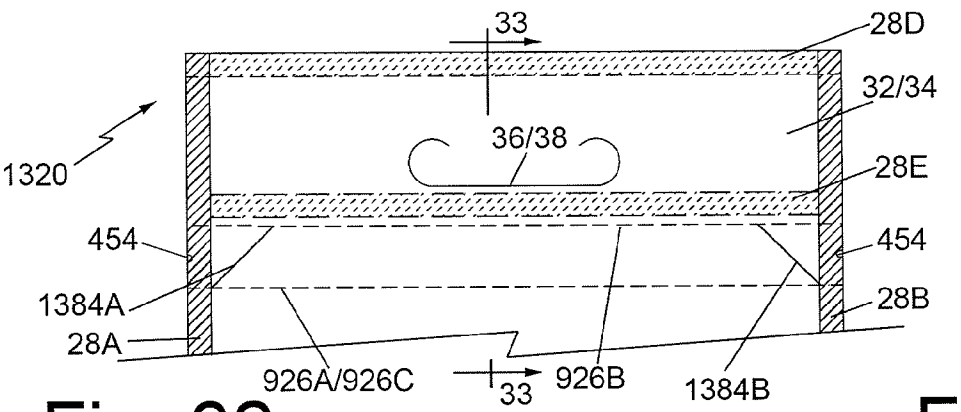
FIG. 32 is a plan view of the top portion of another exemplary embodiment of a package constructed like the package of FIG. 24, with portions of the W-shaped top panel arranged to be cut away to form respective pour spouts to enable the product to be dispensed from the package after it has been filled and sealed.

FIGS. 32 and 33 show another alternative embodiment of a pouch 1320 constructed in accordance with this invention. The pouch 1320 is a variant of the pouch 920. To that end, the center section of the top panel 926 adjacent either side of the pouch is intended to be cut or torn along a line 1384A or 1384B to create a restricted pour spout thereat. Each line 1384A and 1384B extends at an acute angle to the transverse axis of the pouch. Tearing either line 1384A or 1384B can be facilitated through the use of laser scoring the package material to help guide the direction of tearing. All other aspects of the pouch 1220 are the same as the pouch 920 and hence will be given the same reference characters and the details of their construction, arrangement and function will not be reiterated in the interest of brevity.

Figure 35:
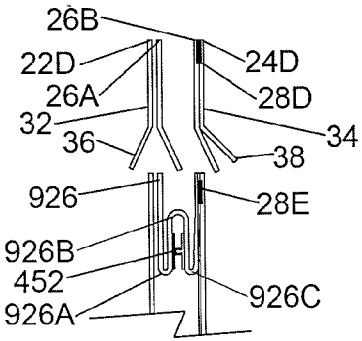
FIG. 35 is a sectional view taken along line 35-35 of FIG. 34.
Figure 34:
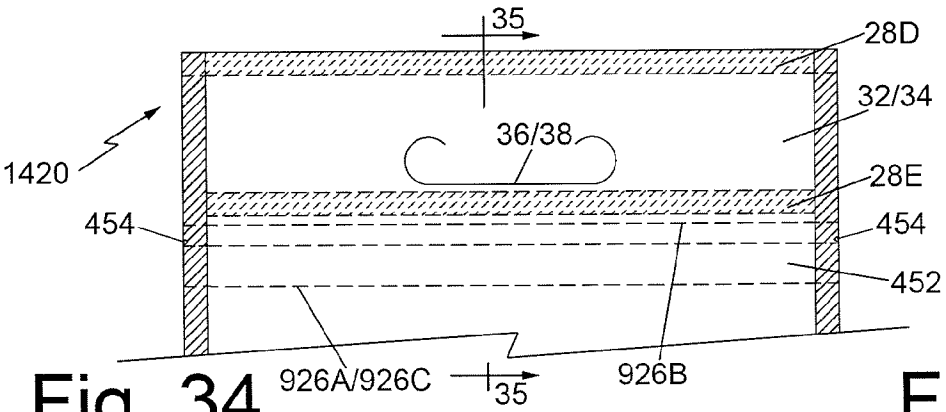
FIG. 34 is a plan view of the top portion of another exemplary embodiment of a package constructed like the package of FIG. 24, with portions of the W-shaped top panel including a press-to-close zipper to form a re-closable opening for the package to enable the product to be dispensed from the package after it has been filled and sealed.

FIGS. 34 and 35 show another alternative embodiment of a pouch 1420 constructed in accordance with this invention. The pouch 1420 is a variant of the pouch 920. To that end, the center section of the top panel 926 which is arranged to be cut or torn includes a press-to-close zipper 452 located immediately below the line at which the center section is to be cut or severed, i.e., the line being located between the tear notches 454. One of the components of the zipper 452 is secured to the inner surface of the portion of the top panel 926 contiguous with the center fold line 926B on one side thereof and the other cooperating component of the zipper is secured to the inner surface of the portion of the top panel 926 contiguous with the center fold line 926B on the other side thereof. The inclusion of the press-to-close zipper 452 in the pouch 1420 provides a means to reclose the pouch after opening. All other aspects of the pouch 1420 are the same as the pouch 920 and hence will be given the same reference characters and the details of their construction, arrangement and function will not be reiterated in the interest of brevity.

Figure 37:
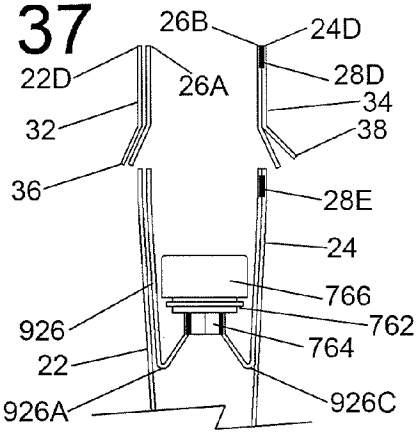
FIG. 37 is a sectional view taken along line 37-37 of FIG. 36.
Figure 36:
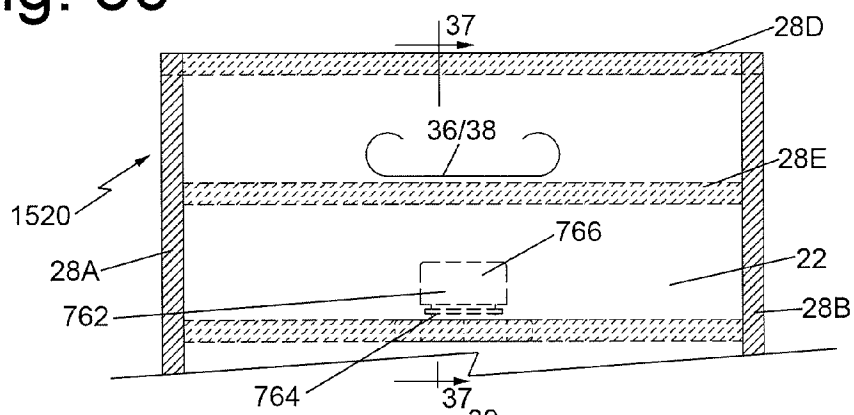
FIG. 36 is a plan view of the top portion of another exemplary embodiment of a package constructed like the package of FIG. 24, with the center portion of the W-shaped top panel including a fitment to enable the product to be dispensed from the package after it has been filled and sealed.

FIGS. 36 and 37 show another alternative embodiment of a pouch 1520 constructed in accordance with this invention. The pouch 1520 is a variant of the pouch 920. To that end, the top panel 926 of the pouch includes a fitment 762. In addition, the length of the extensions 32 and 34 containing the handles 36 and 38, respectively, is increased so that the fitment 762 is located below the handles. This allows the package to be carried more easily. The fitment includes a body portion 764 that is preferably welded into the center section of the top panel 926, i.e., the portion contiguous with the center fold line 926B. A removable cap 766 is also provided on the fitment. All other aspects of the pouch 1520 are the same as the pouch 920 and hence will be given the same reference characters and the details of their construction, arrangement and function will not be reiterated in the interest of brevity.

The inclusion of the fitment in the top panel of this pouch has various applications. One particular application is in combination with a spray nozzle. The pouch could also use a cap and tube to connect to a dispenser. For example, many pesticides and fungicides are dispensed through a trigger activated spray nozzle. For this type of dispensing, the pouch 1520 would include a trigger sprayer, with tube and screw cap. The original cap 766 would be removed, and the sprayer cap and tube would be attached to the fitment. The handles 36 and 38 allow easy portability while spraying or dispensing the product.

Figure 39:
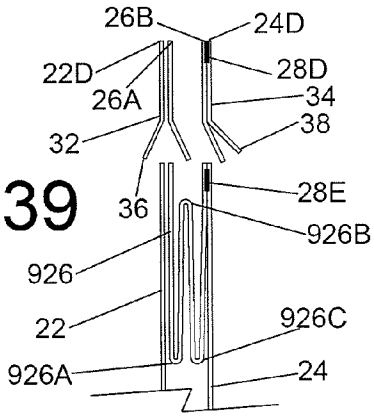
FIG. 39 is a sectional view taken along line 39-39 of FIG. 38.
Figure 38:
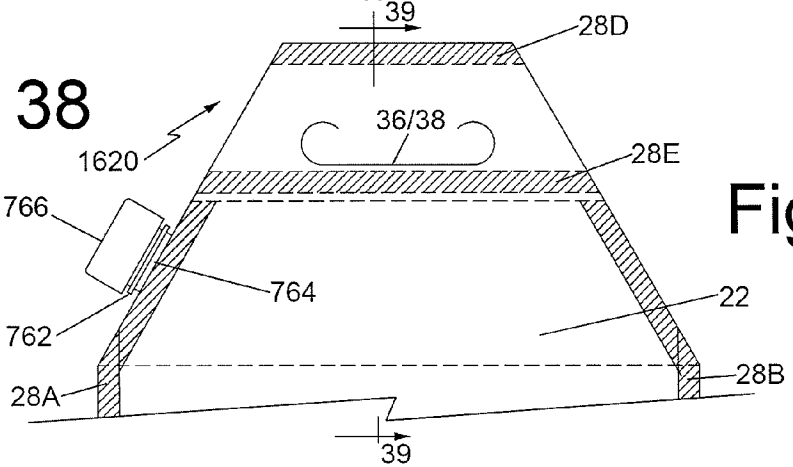
FIG. 38 is a plan view of the top portion of another exemplary embodiment of a package constructed like the package of FIG. 15 but with including a W-shaped top panel like that of FIG. 24.
Figure 40:
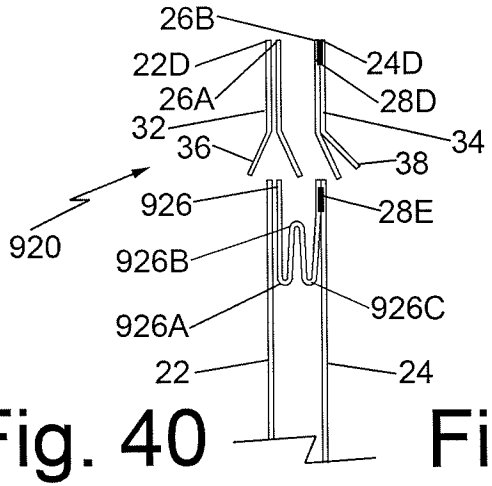
FIGS. 40-44 show the filling sequence of a stand-up pouch like in that of FIG. 25, with FIG. 40 being a vertical sectional view of the top portion of the pouch shown its flat form ready to be filled and sealed.
Figure 41:
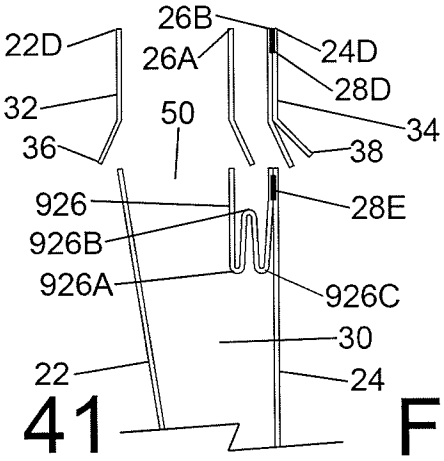

FIGS. 38 and 39 show another alternative embodiment of a pouch 1620 constructed in accordance with this invention. The pouch 1620 is a variant of the pouch 1020, but includes a fitment 762. To that end, the "W-shaped" top panel 926 of the pouch is cut and sealed at an angle similar to the pouch 1020 shown in FIG. 27. The boat shaped base 764 of the fitment 762 is secured, e.g., welded, in place between adjacent surfaces of the top panel 926 at the edge thereof. A removable cap 766 is also provided on the fitment. All other aspects of the pouch 1620 are the same as the pouch 920 and hence will be given the same reference characters and the details of their construction, arrangement and function will not be reiterated in the interest of brevity.

The arrangement of the fitment 762 in the pouch 1620 allows pouring the contents of the pouch through the fitment when its cap is removed. The pouch 1620 can also be used with a spray nozzle as discussed above.

Figure 42:
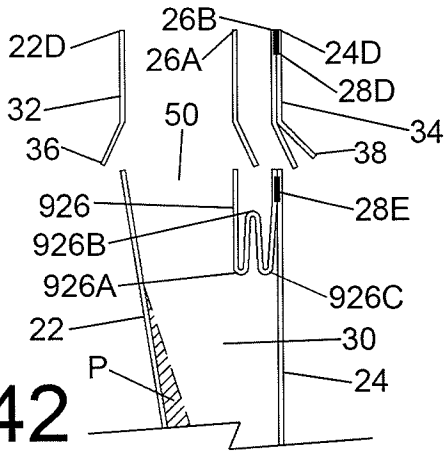
Figure 43:
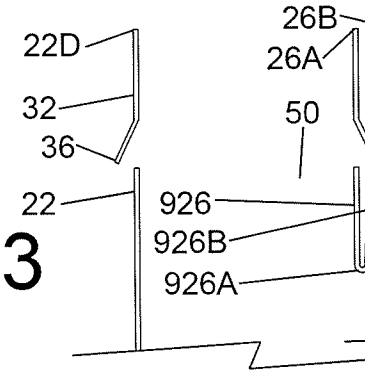
Figure 44:
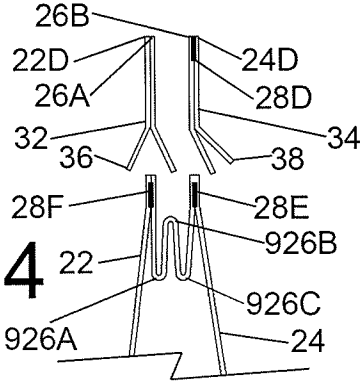

FIGS. 40-44 show the filling sequence of a stand-up pouch 920 like in that shown in FIG. 25. That sequence is similar to the sequence of filling the stand-up pouch 220. In particular, the interface between the top edge portion 22A of the front panel 22 and top edge portion 26A of the top panel 926, is opened from the state shown in FIG. 40 to the state shown in FIG. 41, thereby creating large (full package width) open mouth 50 through which the product P can be introduced into the package's interior. FIG. 42 shows the product P in the process of being introduced through the mouth 50 into the hollow interior space 30 of the package. Once the package is filled to its desired level, i.e., the condition shown in FIG. 43 (although the product is not shown in the figure since that figure is only of the top portion of the pouch), the front panel 22 and the rear panel 24 with the top panel secured thereto are moved towards each other. This action brings the portion of the front panel 22 just below the handle 36 into engagement with the portion of the top panel 926 located at the same distance from the fold line 26C as the heat seal line 28E. At that time those confronting portions can be sealed, e.g., thermally welded or otherwise fixedly secured, together along a transverse seal line 28F as shown in FIG. 44, thereby sealing the product P within the pouch 220.

Figure 46:
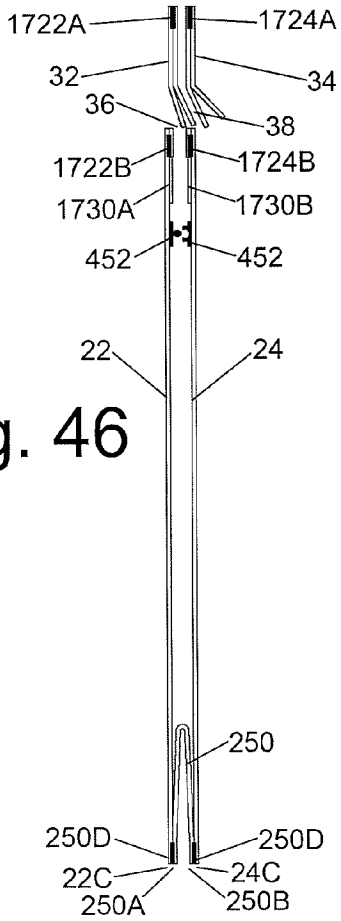
FIG. 46 is a sectional view taken along line 46-46 of FIG. 45.
Figure 45:
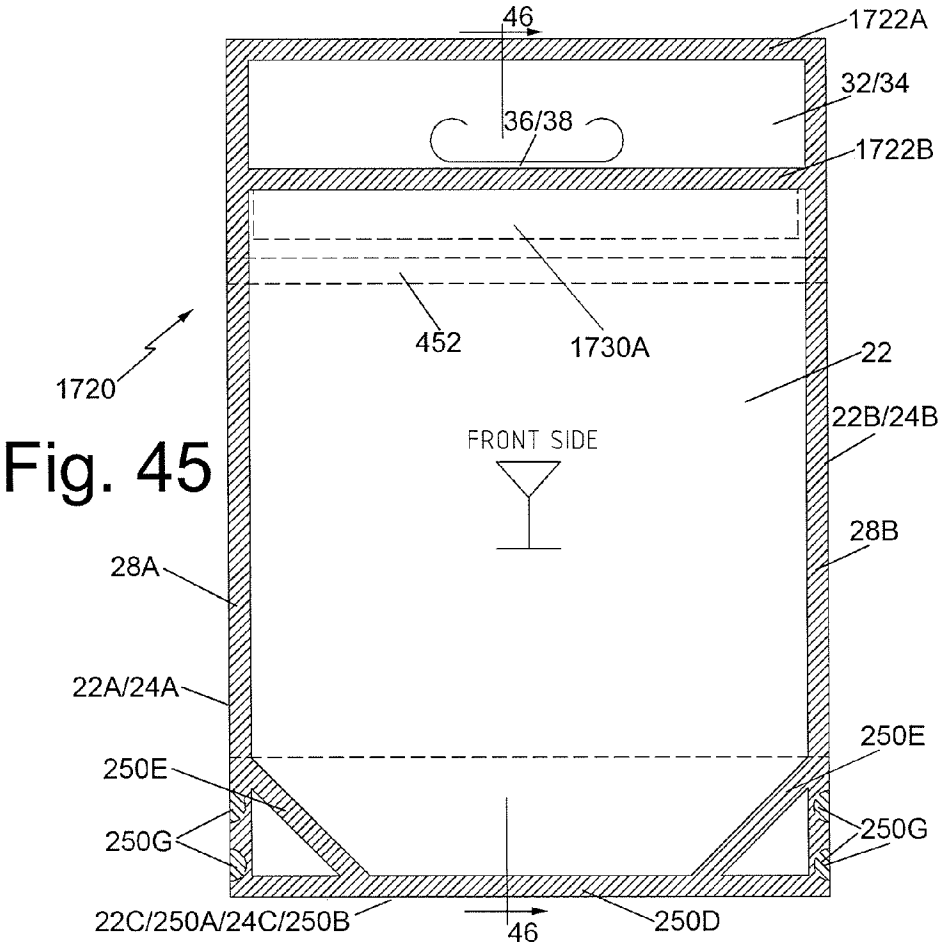
FIG. 45 is a plan view of still another exemplary embodiment of a package constructed in accordance with this invention, that package including a peelable mouth and a zipper closure for enabling the re-closure of the package.

Turning now to FIGS. 45 and 46 there is shown another alternative embodiment of a package 1720 constructed in accordance with this invention. The package 1720 is similar in many respects to the package 220, shown in FIGS. 4 and 5, except that the package 1720 is arranged to be peeled open, instead of being cut open, as is the case of the package 220. Moreover, the package 1720 is re-closable, i.e., it can be resealed, after it is initially opened. To that end, as will be described shortly it includes a press-to-close zipper like that used in the embodiment of the package 420. Thus, in the interest of brevity the common features of the packages 1720, 220 and 420 will be given the same reference numerals and the details of their construction, arrangement and operation will not be reiterated in detail.

As can be seen in FIGS. 45 and 46 the package 1720 basically comprises the package 1720 is in the form of a stand-up pouch and includes a front panel 22, a rear panel 24, and a bottom gusset panel 250, which is of the same width as the front and rear panels 22 and 24, respectively. The front panel 22 and the rear panel 24 are of similar size and shape. In the embodiment shown each panel 22 and 24 is of a rectangular shape and they overlie each other. The front panel 22 includes a pair of side edge portions 22A and 22B, a bottom edge portion 22C, and a top edge portion 22D. The rear panel 24 includes a pair of side edge portions 24A and 24B, a bottom edge portion 24C, and a top edge portion 24D. The side edge portions 22A and 24A are sealed together, e.g., welded, along a seal line 28A. The side edge portions 22B and 24B are sealed, e.g., welded, together along a seal line 28B. The bottom edge portions 22C and 24C are sealed, e.g., welded, together along a seal line 28C. Like the embodiments of the packages described above, the top portions of the panels 22 and 24 form a pair of top extensions 32 and 34. Those extensions include respective handles 36 and 38. Each of the top extensions is formed of two thicknesses of sheet material. This provides a very strong arrangement for carrying a heavy, filled package. In particular, the extension portion of the panel 22 includes a layer 1722 of sheet material secured to the upper portion of the panel 22 by an upper transverse welded seal line 1722A and a lower transverse welded seal line 1722B. In a similar manner, the extension portion of the panel 24 includes a layer 1724 of sheet material secured to the upper portion of the panel 24 by an upper transverse welded seal line 1724A and a lower transverse welded seal line 1724B.

The reinforcing layers 1722 and 1724 may be formed of separate sheets of flexible material. Alternatively, the reinforcing layers 1722 and 1724 may be formed of by use of a V-shaped panel similar to the panel 26C of the package 720 as a precursor. To that end the upper edges of the V-shaped panel can be sealed to the front and rear panels 22 and 24 along the respective top transverse seal lines 1722A and 1724A and then the V-shaped panel can be slit or cut its fold line to thereby produce the two reinforcing layers 1722 and 1724. The lower edge of the reinforcing layer 1722 can then be fixedly secured (e.g., welded) to the front panel 22 along the transverse seal line 1722B and the lower edge of the reinforcing layer 1724 can then be fixedly secured (e.g., welded) to the rear panel 24 along the transverse seal line 1724B.

The sheet material making up the reinforcing layers 1722 and 1724 can be the same as the material making up the panels 22 and 24 or may be a different material. In this exemplary embodiment the panels the reinforcing layers 1730A and 1730B are the same material as the panels 22 and 24, e.g., a lamination of 48 gauge polyester (PET), 60 gauge biaxially oriented nylon (BON) and 400 gauge linear low density polyethylene (LLDPE) held together by an adhesive.

Like other embodiments described above, the handles 36/38 are in the form of cuts through the two layers of sheet material making up each of the two top extensions 32/34.

The bottom gusset panel 250 is arranged to be flattened when the pouch 1720 is filled to serve as the base on which the stand-up pouch can stand in a vertical orientation. One edge portion 250A of the bottom gusset panel 250 is secured to the bottom edge portion 22C of the front panel 22 along a seal line 250D. In a similar manner the opposite edge portion 250B of the bottom gusset panel 250 is secured to the bottom edge portion 24C of the rear panel 24 along another seal line 250D. As is conventional the bottom gusset of the pouch 220 includes contoured seals at the bottom of the pouch. In particular, an angular seal line 250E secures the front panel 22 to the underlying portion of the gusset panel 250 between the seal lines 28A and 250D on one side of the package and a similar angular seal line 250F secures the front panel 22 to the underlying portion of the gusset panel 250 between the seal lines 28B and 250D on the opposite side of the package. In a similar manner an angular seal line like seal line 250E secures the rear panel 24 to the underlying portion of the gusset panel 250 between the seal lines 28A and 250D on one side of the package and a similar angular seal line like seal line 250F secures the rear panel 24 to the underlying portion of the gusset panel 250 between the seal lines 28B and 250D on the opposite side of the package. Conventional D-holes 250G are punched through the bottom gusset to hold the bottom sides together.

Unlike the packages described above the package 1720 does not include a folded top panel, like the V-shaped panel 26 or the W-shaped panel 926, located in the mouth of the package. Instead the inner surface of the panel 22 immediately below the lower transverse seal line 1722B includes a rectangular area of a pattern coated easy-open seal coating 1730A. In a similar manner, the inner surface of the panel 24 immediately below the lower transverse seal line 1724B includes a rectangular area of a pattern coated easy-open seal coating 1730B. Those pattern coated areas 1730A and 1730B do not extend to the welded side seals 28A and 28B and serve to form the openable mouth of the package 1720. Thus, these areas can be formed of any suitable material which sticks together to form a seal, but can be peeled apart when desired to open the mouth of the package. Examples of such materials are found in U.S. Pat. No. 4,705,174 (Goglio); U.S. Pat. No. 4,518,087 (Goglio) and U.S. Pat. No. 6,355,732 (Beer), whose disclosures are incorporated by reference herein.

In order to enable the package to be re-closable after it has been opened, it includes a press-to-close zipper 452 like that described above with reference to the package embodiment 420. To that end one of the two components of the zipper 452 is fixedly secured to the inner surface of the front panel 22 below the pealable seal area 1730A, while the mating/cooperating component of the zipper 452 is fixedly secured to the inner surface of the rear panel 24 below the pealable seal area 1730B. It should be pointed out at this juncture that the position of the press-to-close zipper 452 and the peelable coating 1730A/1730B can be interchanged to meet the needs of various applications, i.e., the press-to-close zipper may be located immediately below the lower transverse seal lines 1722A and 1722B, while the peelable coating 1730A/1730B can be located below the press-to-close zipper.

It should be pointed out at this juncture that the package 1720 need not be of the stand-up pouch configuration like that shown. Thus, it can be made as a flat pouch similar to the flat pouch 20.

As should be appreciated by those skilled in the art, the package 1720 is simple in construction and thus can be readily manufactured and filled. This embodiment of the package of the subject invention is generally targeted for holding dry products, which will not stress the peel-able seal. The other embodiments of the packages of this invention as disclosed herein are designed to be able to package both dry and liquid products. Liquids tend to stress the peelable seal and thus have the potential to cause this type of seal to open during distribution.

As should be appreciated from the above discussion the packages of this invention either provide a pair of handles or a single handle for carrying the package. In the case where two handles are provided they are formed of four sheets of the flexible material making up the package and extend from the top of the package. Thus, the packages of this invention utilizing four layers of sheet material to form the handles are stronger and capable of carrying more weight than prior art packages which make use of only two sheets of material to form the handles. Moreover, the four layers of material forming the extensions helps to distribute the weight of the package more evenly than the prior art and thus make carrying the package more comfortable. Further still, in some embodiments of the package the pairing of the extensions allows for one extension to be removed (either cut or torn away), thereby providing access to the package's contents, and the package still has one handle remaining for transportation. Even if the prior art makes use of a handle formed of two sheets of material located in the center of the pouch that handle may be lost when the pouch's top is torn/cut to access the contents of the pouch, whereas with the subject invention there is at least one handle formed of two sheets of material remaining after the pouch has been opened.

In accordance with a preferred aspect of this invention, the handle holes are cut in the center of the extensions so that the package hangs vertically when carried. This arrangement, while preferred is not mandatory. Thus, the handle(s) can be located off-center if desired. In the case of the embodiments making use of only a single extension, the handle is still preferably located in the center of the package so that when the package is carried the package hangs vertically.

Often prior art standup pouches have their handle formed into the top corner of the pouch. This location restricts the opening. While it is possible to locate the handle in the center of the top of the pouch, the handle would be torn away during opening. It is possible to place an "Innolock" style zipper in the front face of a pouch, thereby providing access without removing the handle, but this technology does not provide full width opening. The subject invention provides a full width opening.

As demonstrated in the embodiments of FIGS. 3, 6, 15, 27 and 38 the extensions can be cut at an angle, thereby forming a tapered top which has visual appeal. Removing the cut portions of the pouch allows re-cycling clean material. After use, the package materials have more limited recycle-ability.

In conclusion the subject invention addresses the needs of the prior art by providing a package that can be in the form of a stand-up pouch or a flat pouch, either of which can be filled higher than prior art pouches. In addition, the subject invention makes use of at least one handle that is centered in the package, so that when the package is carried, it doesn't tilt. Thus, after opening any package of the subject invention can be carried readily without spilling its contents. Further still, the mouth of the subject packages can be made to extend or span the full width of the package, thereby providing a larger space to access the contents than other packages making use of carrying handles. Further yet, packages of this invention may be constructed so that they can be peeled open, rather than cut open, and then resealed if desired.

Without further elaboration the foregoing will so fully illustrate our invention that others may, by applying current or future knowledge, adopt the same for use under various conditions of service.

We claim:

1. A flexible package for holding a product therein, said package comprising a front panel, a rear panel and a top panel, said front and rear panels being coextensive in size and secured together to define a hollow interior therebetween, each of said panels being formed of a flexible sheet material, said front panel having a pair of side edge portions, a bottom edge portion, and a top edge portion, said rear panel having a pair of side edge portions, a bottom edge portion, and a top edge portion, with respective ones of said side edge portions of said front panel being secured to respective ones of said side edge portions of said rear panel to form respective side sealed edge portions, with said bottom edge portion of said front panel being secured to said bottom edge portion of said rear panel to form a bottom sealed edge portion, said top panel comprising a V-shaped member having a first reinforcing panel and a second reinforcing panel which are located on opposite sides of a first fold line, said first reinforcing panel having a top edge portion, said second reinforcing panel having a top edge portion, said top edge portion of said second reinforcing panel being secured to said top edge portion of said rear panel with said second reinforcing panel being juxtaposed over a portion of said rear panel contiguous with said top edge portion of said rear panel to form a dual-sheet first top extension having a top end and with said top edge portion of said first reinforcing panel being juxtaposed over a portion of said front panel contiguous with said top edge portion of said front panel to form a dual-sheet second top extension having a top end, said second top extension having an open interface located between said first reinforcing panel and said top edge portion of said front panel at said top end of said second top extension, said open interface being located between said side sealed edge portions, said hollow interior being bounded by said side sealed edge portions, said bottom sealed edge portions and said open interface, said open interface being configured to provide access to said hollow interior to thereby enable the filling of said hollow interior with the product through said open interface, said open interface being configured to be sealed thereafter to enclose the product within said hollow interior, said first top extension comprising a handle for carrying said package, said handle comprising a shaped cut in said rear panel and a correspondingly shaped cut in said second reinforcing panel, said shaped cut in said rear panel being surrounded by a surrounding area of said rear panel, said shaped cut in said second reinforcing panel being surrounded by a surrounding area of said second reinforcing panel, said shaped cuts being superimposed over each other, with a first portion of said rear panel contiguous with said shaped cut in said rear panel being foldable away from said surrounding portion of said rear panel and with a second portion of said second reinforcing panel contiguous with said shaped cut in said second reinforcing panel being foldable away from said surrounding portion of said second reinforcing panel to form a flap at said handle, and with one of said front and rear panels comprising a predetermined cut line located immediately adjacent one of said top extensions and configured to be cut therealong to thereby provide access to the product within said hollow interior.

2. The flexible package of claim 1 wherein said package comprises a flat pouch.

3. The flexible package of claim 1 wherein said package comprises a stand-up pouch, said stand up pouch including a bottom gusset panel formed of a flexible sheet material, said bottom gusset panel having a pair of edge portions, one of said edge portions of said bottom gusset panel being secured to said bottom edge portion of said front panel and the other of said edge portions of said bottom gusset panel being secured to said bottom edge portion of said rear panel.

4. The flexible package of claim 1 wherein said V-shaped portion of said top panel comprises a portion of a W-shaped configuration, said top panel being folded along said first fold line and along second and third fold lines to form said W-shaped configuration, with said top edge portions of said top panel being located on opposite sides of said fold lines.

5. The flexible package of claim 4 wherein said package comprises a flat pouch.

6. The flexible package of claim 4 wherein said package comprises a stand-up pouch, said stand up pouch including a bottom gusset panel formed of a flexible sheet material, said bottom gusset panel having a pair of edge portions, one of said edge portions of said bottom gusset panel being secured to said bottom edge portion of said front panel and the other of said edge portions of said bottom gusset panel being secured to said bottom edge portion of said rear panel.

7. The flexible package of claim 1 wherein each of said top extensions includes a handle therein.

8. The flexible package of claim 1 wherein a press-to-close zipper is interposed between said top panel and said top edge portion of said front panel.

9. The flexible package of claim 1 additionally comprising a fitment secured to one of said front and rear panels.

10. The flexible package of claim 9 wherein said fitment is secured between said front panel and said rear panel at one of said side edges thereof.

11. The flexible package of claim 1 wherein said handle comprises an opening cut into said flexible sheet material.

12. The flexible package of claim 4 wherein said second fold line of said W-shaped configuration is located between said first and second fold lines, and wherein a portion of said top panel adjacent said second fold line forms a pouring spout.

13. The flexible package of claim 4 wherein said second fold line of said W-shaped configuration is located between said first and second fold lines, and wherein said top panel includes a portions adjacent said second fold line at which a fitment is located.

14. The flexible package of claim 1 additionally comprising a peelable seal located adjacent said interface.

15. The flexible package of claim 14 additionally comprising a press-to-close zipper located adjacent said interface.

16. The flexible package of claim 15 wherein said at least one reinforcing panel comprises a first reinforcing panel and a second reinforcing panel, said first reinforcing panel being secured to said top edge portion of said front panel to form a first top extension, said second reinforcing panel being secured to said top edge portion of said rear panel to form a second top extension, each of said extensions having a handle for carrying said package.

* * * * *